US006482583B1

(12) United States Patent
Ikari

(10) Patent No.: US 6,482,583 B1
(45) Date of Patent: Nov. 19, 2002

(54) PHOTOTHERMOGRAPHIC MATERIAL

(75) Inventor: Shinji Ikari, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/632,337

(22) Filed: Aug. 3, 2000

(30) Foreign Application Priority Data

Aug. 3, 1999 (JP) ..... 11-220297

(51) Int. Cl.[7] ..... G03C 1/498; G03C 1/34; G03C 1/09

(52) U.S. Cl. ..... 430/619; 430/567; 430/569; 430/604; 430/607; 430/611; 430/613; 430/614; 430/615

(58) Field of Search ..... 430/619, 604, 430/567, 568, 613, 614, 615, 607, 611, 569

(56) References Cited

U.S. PATENT DOCUMENTS

| | | | | | |
|---|---|---|---|---|---|
| 316,886 | A | * | 5/1992 | Koide et al. | 430/203 |
| 5,378,594 | A | * | 1/1995 | Okazaki et al. | 430/545 |
| 5,922,529 | A | * | 7/1999 | Tsuzuki et al. | 430/619 |
| 5,962,212 | A | * | 10/1999 | Suzuki et al. | 430/619 |

* cited by examiner

*Primary Examiner*—Thorl Chea
(74) *Attorney, Agent, or Firm*—Birch, Stewart, Kolasch & Birch, LLP

(57) ABSTRACT

Provided is a photothermographic material having, on one surface of its support, at least one type of photosensitive silver halide grains, a non-photosensitive silver salt of an organic acid, a reducing agent for silver ions, and a binder; which contains a compound of the following general formula (I) and in which the silver halide grains have a hexacyano-metal complex of the following general formula (II) in their outermost surfaces:

(I)

wherein $R^{11}$, $R^{12}$, $R^{13}$ and $R^{14}$ may be the same or different, and each independently represents a hydrogen atom, a halogen atom, a hydroxyl group, an amino group, a nitro group, a cyano group, a carboxyl group or its salt, a sulfo group or its salt, an alkyl group, an alkenyl group, an alkynyl group, an aryl group, a heterocyclic group, or a group of $R^{15}$—D—; where $R^{15}$ represents a hydrogen atom, a halogen atom, a hydroxyl group, an amino group, a nitro group, a cyano group a carboxyl group or its salt, a sulfo group or its salt, an alkyl group, an alkenyl group, an alkynyl group, an aryl group, or a heterocyclic group; and D represents —$SO_2$—, —O—, —S—, —CO—, —COO—, —OCO—, —CONH—, —NHCO—, —NHCONH—, —$SO_2$NH— or —$NHS0_2$—;

$$[M(CN)_6]^{n-} \quad \text{(II)}$$

wherein M represents Fe, Ru, Os, Co, Rh, Ir, Cr or Re; and n indicates 3 or 4. The material has high sensitivity and is fogged little, and gives good images. While stored before it is processed for image formation, the material enjoys good storage stability.

12 Claims, No Drawings

PHOTOTHERMOGRAPHIC MATERIAL

FIELD OF THE INVENTION

The present invention relates to a photothermographic material.

BACKGROUND OF THE INVENTION

In the field of medical diagnosis, these days much desired is reducing the wastes of processing solutions for environmental protection and space saving. In that situation, required are techniques with photothermographic materials for medical diagnosis and ordinary photography capable of being efficiently exposed with laser image setters or laser imagers to form sharp and clear monochromatic images of high resolution. Such photothermographic materials could provide users with simple photothermographic systems not requiring solution-type processing chemicals and therefore not polluting the environment.

The same applies to the field of ordinary image-forming materials, which, however, shall differ from those in the field of medical diagnosis. Specifically, photo-images for medical diagnosis must clarify the details of body parts and therefore must have sharp and good image quality with fine graininess. In addition, for easy diagnosis thereon, preferred are cold monochromatic images in the field of medical diagnosis. At present, various types of hard copy systems with pigment and dye, for example, ink jet printers and electrophotographic systems are available for ordinary imaging systems. However, No satisfactory systems for forming photo-images enough for medical diagnosis are available.

On the other hand, photothermographic systems with silver salts of an organic acid used therein are described, for example, in U.S. Pat. Nos. 3,152,904 and 3,457,075, and in D. Klosterboer, Imaging Processes and Materials, "Thermally Processed Silver Systems", Neblette, 8th ed., compiled by J. Sturge, V. Walworth and A. Shepp, Chapter 9, p.279, (1989). In general, photothermographic materials have a photosensitive layer which contains a catalytically active amount of a photocatalyst (e.g., silver halide), a reducing agent, a reducible silver salt (e.g., silver salt of an organic acid), and optionally a color tone adjustor for controlling silver tones, all of which are dispersed in a binder matrix in the layer. Photothermographic materials of that type are, after having been imagewise exposed, heated at a high temperature (for example, at 80° C. or higher) to form monochromatic silver images through oxidation-reduction reaction between the silver halide or the reducible silver salt (which serves as an oxidizing agent) and the reducing agent therein. The oxidation-reduction reaction is accelerated by the catalytic action of the latent image of the exposed silver halide. Therefore, the monochromatic silver images are formed in the exposed area of the materials. This technique is disclosed in many references such as typically U.S. Pat. No. 2,910,377 and Japanese Patent Publication (hereinafter referred to as JP-B) 4924/1968. The photothermographic systems with a silver salt of an organic acid could realize good image quality and tones enough for photo-images for medical diagnosis applications.

Silver halide grains are used for the photosensitive elements in the photothermographic materials. Silver halide grains having a grain size of 0.01 $\mu$m or larger can be produced according to a specifically controlled method for producing them in photographic gelatin. However, fine silver halide grains having a grain size of from 0.005 $\mu$m to 0.1 $\mu$m have a problem that, after a while, smaller grains often dissolve and aggregate to be large grains through physical ripening. To that effect, such fine silver halide grains are unstable.

One method for preventing silver halide grains from growing large is known, in which is used a stabilizer for stabilizing photographic performances of the grains. The stabilizer includes, for example, tetrazaines and mercaptothiazoles. However, in case where such a stabilizer is added to silver halide grains to such a degree that it can fix the size of the grains, the grains could hardly receive a spectral sensitizing dye to be adsorbed onto their surfaces. As a result, photographic materials containing the thus-stabilized silver halide grains could not ensure desired sensitivity. In the method, therefore, it is difficult to well control the size of silver halide grains without interfering with the photographic performance. If the size of silver halide grains can be controlled, some advantages can be obtained. For example, emulsions of the grains could be stored more stably, and the number of the grains produced from a predetermined amount of silver could be increased.

One problem of photothermographic materials of the type mentioned above is that they are often fogged and desensitized while stored at high temperatures in high humidity before image formation.

One technique known in the art for stabilizing photographic performances of such photothermographic materials comprises adding a mercapto-heterocyclic compound or a tetrazaine compound to the materials, as described in Japanese Patent Laid-Open (hereinafter referred to as JP-A) 225445/1995. However, even though containing such a compound, the photothermographic materials are still significantly fogged and desensitized while stored at high temperatures in high humidity before image formation, and are therefore not satisfactory.

Given that situation, it is desired to provide photothermographic materials which are fogged little and have good photographic performances and which, even stored at high temperatures in high humidity before image formation, are still fogged little and desensitized little.

SUMMARY OF THE INVENTION

The object of the present invention is to solve the problems in the related art mentioned above. Specifically, the object of the present invention is to provide a high-sensitivity photothermographic material which is fogged little and gives good images and which has improved storage stability before processed for image formation.

Having assiduously studied so as to solve the problems mentioned above, the present inventors have found that, when silver halide grains having a hexacyano-metal complex in their outermost surfaces are used in a photothermographic material and when a mercaptobenzimidazole compound is added thereto, then excellent photothermographic materials having desired advantages can be obtained. On the basis of this finding, the present inventors have completed the present invention.

According to the invention, there is provided a photothermographic material having, on one surface of its support, at least one type of photosensitive silver halide grains, a non-photosensitive silver salt of an organic acid, a reducing agent for silver ions, and a binder; which contains a compound of the following general formula (I) and in which the silver halide grains have a hexacyano-metal complex of the following general formula (II) in their outermost surfaces:

(I)

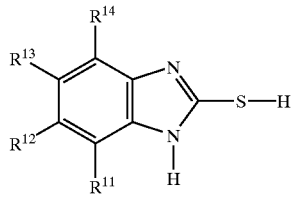

wherein $R^{11}$, $R^{12}$, $R^{13}$ and $R^{14}$ may be the same or different, and each independently represents a hydrogen atom, a halogen atom, a hydroxyl group, an amino group, a nitro group, a cyano group, a carboxyl group or its salt, a sulfo group or its salt, an alkyl group, an alkenyl group, an alkynyl group, an aryl group, a heterocyclic group, or a group of $R^{15}$—D—; where $R^{15}$ represents a hydrogen atom, a halogen atom, a hydroxyl group, an amino group, a nitro group, a cyano group, a carboxyl group or its salt, a sulfo group or its salt, an alkyl group, an alkenyl group, an alkynyl group, an aryl group, or a heterocyclic group; and D represents —$SO_2$—, —O—, —S—, —CO—, —COO—, —OCO—, —CONH—, —NHCO—, —NHCONH—, —$SO_2$NH— or —$NHSO_2$—;

$$[M(CN)_6]^{n-} \quad \text{(II)}$$

wherein M represents Fe, Ru, Os, Co, Rh, Ir, Cr or Re; and n indicates 3 or 4.

Preferably in the photothermographic material of the invention, the silver halide grains contain, in its inside, a coordination metal complex having a metal of an element of Groups III to XIV in the Periodic Table and/or a metal ion of an element of Groups III to XIV in the Periodic Table.

More preferably, the coordination metal complex contained in the inside of silver halide grains is an iridium complex.

Preferably, a compounds of the general formula (I) wherein one of $R^{11}$, $R^{12}$, $R^{13}$ and $R^{14}$ is methyl, is used in the present invention.

Preferably, a compounds of the general formula (I) wherein two or three of $R^{11}$, $R^{12}$, $R^{13}$ and $R^{14}$ are a hydrogen atom, is used in the present invention.

Preferably, the silver halide grains have, in their outermost surfaces, a hexacyano-metal complex of the general formula (II) wherein M represents Fe or Ru.

Preferably, the amount of the compound of formula (I) to be added is between $1\times10^{-5}$ mols and $1\times10^{-2}$ mols per mol of silver in the emulsion layer.

Preferably, the amount of the hexacyano-metal complex of the formula (II) to be added is between $1\times10^{-5}$ mols and $1\times10^{-2}$ mols per mol of silver.

Preferably, the amount of the coordination metal complex or metal ion to be added to the grains is between $1\times10^{-8}$ mols and $1\times10^{-3}$ mols per mol of silver.

Preferably, the silver halide grains have a mean grain size falling between 0.008 $\mu$m and 0.07 $\mu$m.

PREFERRED EMBODIMENTS OF THE INVENTION

Embodiments of the photothermographic material of the invention and methods for carrying out the invention are described below in detail.

The photothermographic material of the invention has, on one surface of its support, at least one type of photosensitive silver halide grains, a non-photosensitive silver salt of an organic acid, a reducing agent for silver ions, and a binder, and contains a compound of formula (I) defined herein, in which the silver halide grains have a hexacyano-metal complex of formula (II) in their outermost surfaces.

The mercaptobenzimidazole compound of formula (I) for use in the invention is described in detail. The mercaptobenzimidazole compound of formula (I) is used for supersensitizing the photothermographic material and for improving the storage stability of the material before and after development.

In formula (I), $R^{11}$, $R^{12}$, $R^{13}$ and $R^{14}$ may be the same or different, and each independently represents a hydrogen atom, a halogen atom (e.g., chlorine atom, bromine atom, iodine atom, etc.), a hydroxyl group, an amino group, a nitro group, a cyano group, a carboxyl group or its salt (especially, its alkali metal salt), a sulfo group or its salt (especially, its alkali metal salt), an alkyl group optionally having one or more substituents, an alkenyl group optionally having one or more substituents, an alkynyl group optionally having one or more substituents, an aryl group optionally having one or more substituents, a heterocyclic group optionally having one or more substituents, or a group of $R^{15}$—D— where $R^{15}$ represents a hydrogen atom, a halogen atom, a hydroxyl group, an amino group, a nitro group, a cyano group, a carboxyl group or its salt, a sulfo group or its salt, an alkyl group optionally having one or more substituents, an alkenyl group optionally having one or more substituents, an alkynyl group optionally having one or more substituents, an aryl group optionally having one or more substituents, or a heterocyclic group optionally having one or more substituents, and D represents —$SO_2$—, —O—, —S—, —CO—, —COO—, —OCO—, —CONH—, —NHCO—, —NHCONH—, —$SO_2$NH— or —$NHSO_2$—.

The alkyl group referred to herein may be linear, branched, cyclic or a combination thereof. Preferably, the alkyl group has from 1 to 8 carbon atoms, more preferably from 1 to 4 carbon atoms.

The substituent which the alkyl group may have includes, for example, an alkyl group preferably having from 1 to 20, more preferably from 1 to 12, even more preferably from 1 to 8 carbon atoms, such as methyl, ethyl, n-propyl, isopropyl, n-butyl, iso-butyl, tert-butyl, n-octyl, n-decyl, n-hexadecyl, cyclopropyl, cyclopentyl, cyclohexyl, etc.; an alkenyl group preferably having from 2 to 20, more preferably from 2 to 12, even more preferably from 2 to 8 carbon atoms, such as vinyl, allyl, 2-butenyl, 3-pentenyl, etc.; an alkynyl group preferably having from 2 to 20, more preferably from 2 to 12, even more preferably from 2 to 8 carbon atoms, such as propargyl, 3-pentynyl, etc.; an aryl group preferably having from 6 to 30, more preferably from 6 to 20, even more preferably from 6 to 12 carbon atoms, such as phenyl, p-methylphenyl, naphthyl, etc.; a substituted or unsubstituted amino group preferably having from 0 to 20, more preferably from 0 to 10, even more preferably from 0 to 6 carbon atoms, such as amino, methylamino, dimethylamino, diethylamino, dibenzylamino, etc.; an alkoxy group preferably having from 1 to 20, more preferably from 1 to 12, even more preferably from 1 to 8 carbon atoms, such as methoxy, ethoxy, butoxy, etc.; an aryloxy group preferably having from 6 to 20, more preferably from 6 to 16, even more preferably from 6to 12 carbon atoms, such as phenyloxy, 2-naphthyloxy, etc.; an acyl group preferably having from 1 to 20, more preferably from 1 to 16, even more preferably from 1 to 12 carbon atoms, such as acetyl, benzoyl, formyl, pivaloyl, etc.; an alkoxycarbonyl group preferably having from 2 to 20, more preferably from 2 to 16, even more preferably from 2 to 12 carbon atoms, such as methoxycarbonyl, ethoxycarbonyl, etc.; an aryloxy-carbonyl group preferably having from 7 to 20, more preferably from 7 to 16, even more preferably from 7 to 10 carbon atoms, such as phenyloxycarbonyl, etc.; an acyloxy group preferably having from 2 to 20, more preferably from 2 to 16, even more preferably from 2 to 10 carbon atoms, such as acetoxy, benzoyloxy, etc.; an acylamino group preferably having from 2 to 20, more preferably from 2 to 16, even more preferably from 2 to 10 carbon atoms, such as acetylamino, benzoylamino, etc.; an alkoxycarbonylamino group preferably having from 2 to 20, more preferably from 2 to 16, even more preferably from 2 to 12 carbon atoms, such as methoxycarbonylamino, etc.; an aryloxycarbonylamino group preferably having from 7 to 20, more preferably from 7 to 16, even more preferably from 7 to 12 carbon atoms, such as phenyloxycarbonylamino, etc.; a sulfonylamino group preferably having from 1 to 20, more preferably from 1 to 16, even more preferably from 1 to 12 carbon atoms, such as methanesulfonylamino, benzenesulfonylamino, etc.; a sulfamoyl group preferably having from 0 to 20, more preferably from 0 to 16, even more preferably from 0 to 12 carbon atoms, such as sulfamoyl, methylsulfamoyl, dimethylsulfamoyl, phenylsulfamoyl, etc.; a carbamoyl group preferably having from 1 to 20, more preferably from 1 to 16, even more preferably from 1 to 12 carbon atoms, such as carbamoyl, methylcarbamoyl, diethylcarbamoyl, phenylcarbamoyl, etc.; an alkylthio group preferably having from 1 to 20, more preferably from 1 to 16, even more preferably from 1 to 12 carbon atoms, such as methylthio, ethylthio, etc.; an arylthio group preferably having from 6 to 20, more preferably from 6 to 16, even more preferably from 6 to 12 carbon atoms, such as phenylthio, etc.; a sulfonyl group preferably having from 1 to 20, more preferably from 1 to 16, even more preferably from 1 to 12 carbon atoms, such as mesyl, tosyl, phenylsulfonyl, etc.; asulfinyl group (preferably having from 1 to 20, more preferably from 1 to 16, even more preferably from 1 to 12 carbon atoms, such as methanesulfinyl, benzenesulfinyl, etc.; an ureido group preferably having from 1 to 20, more preferably from 1 to 16, even more preferably from 1 to 12 carbon atoms, such as ureido, methylureido, phenylureido, etc.; a phosphoric acid amido group preferably having from 1 to 20, more preferably from 1 to 16, even more preferably from 1 to 12 carbon atoms, such as diethylphosphoric acid amido, phenylphosphoric acid amido, etc.; a hydroxyl group, a mercapto group, a halogen atom (e.g., fluorine atom, chlorine atom, bromine atom, iodine atom), a cyano group, a sulfo group or an esterified sulfo group, a carboxyl group or an esterified carboxyl group, a nitro group, a hydroxamic acid group, a sulfino group, a hydrazino group, a heterocyclic group (e.g., imidazolyl, pyridyl, furyl, piperidyl, morpholino, etc.), etc. These substituents may be substituted with any additional substituents. Two or more substituents, if any, may be the same or different.

Specific examples of the alkyl group optionally having one or more substituents are a methyl group, an ethyl group, a propyl group, a hydroxymethyl group, a hydroxypropyl group, a diethylaminomethyl group, a morpholinomethyl group, a benzyl group, a phenethyl group, a carboxymethyl group, etc.

The alkenyl group referred to herein maybe linear, branched, cyclic or a combination thereof. The position and the number of double bonds therein are not specifically defined. Preferably, the alkenyl group has from 3 to 8 carbon atoms, more preferably from 3 or 4 carbon atoms. For examples of the substituent which the alkenyl group may have, mentioned are the same as those mentioned hereinabove for the alkyl group. Specific examples of the alkenyl group are an allyl group, a butenyl group, an octenyl group, etc.

The alkynyl group referred to herein may be linear, branched, cyclic or a combination thereof. The position and the number of triple bonds therein are not specifically defined. The alkynyl group referred to herein preferably has from 3 to 8 carbon atoms, more preferably from 3 or 4 carbon atoms. For examples of the substituent which the alkynyl group may have, mentioned are the same as those mentioned hereinabove for the alkyl group. Specific examples of the alkynyl group are a propynyl group, a butynyl group, an octynyl group, etc.

The aryl group referred to herein may be mono-cyclic, or may have a condensed ring structure. Preferably, it has from 6 to 12 carbon atoms. For examples of the substituent which the aryl group may have, mentioned are the same as those mentioned hereinabove for the alkyl group. Specific examples of the aryl group are a phenyl group, a tolyl group, etc.

The heterocyclic group referred to herein is preferably a 5-membered or 6-membered ring containing a nitrogen or oxygen atom as the ring-constituting hetero atom. Examples thereof includes a pyridyl group, a pyrimidyl group, a furyl group, etc. Especially preferred is a 2-pyridyl group. For examples of the substituent which the heterocyclic group may have, mentioned are the same as those mentioned hereinabove for the alkyl group.

The alkyl group for $R^{15}$ in the group of $R^{15}$—D— is preferably a lower alkyl group having from 1 to 4 carbon atoms; and the aryl group for $R^{15}$ preferably has from 6 to 12 carbon atoms, and is more preferably a phenyl group.

Specific examples of the group of $R^{15}$—D— includes a methylsulfonyl group, a phenylsulfonyl group, an acetoxy group, a methoxycarbonyl group, an acetylamino group, a benzoylamino group, a carbamoyl group, a methylsulfonylamino group, a sulfamoyl group, etc.

Among compounds of formula (I), especially preferred are those where one of $R^{11}$, $R^{12}$, $R^{13}$ and $R^{14}$ is a methyl group.

Also preferred are those of formula (I) where two or three of $R^{11}$, $R^{12}$, $R^{13}$ and $R^{14}$ are hydrogen atoms.

Specific examples of compounds of formula (I) for use herein are mentioned below, but the present invention is not limited thereto.

I-1

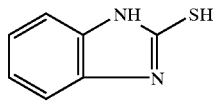

I-2

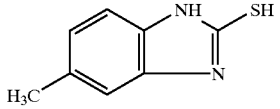

I-3

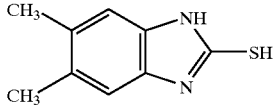

-continued

I-4

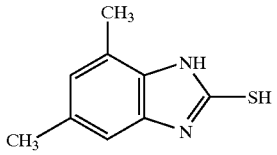

I-5

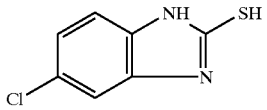

I-6

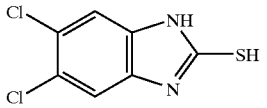

I-7

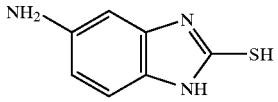

I-8

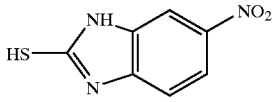

I-9

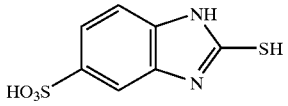

I-10

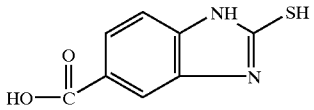

I-11

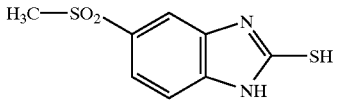

I-12

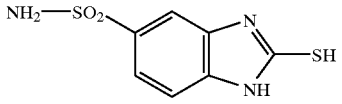

I-13

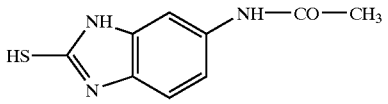

I-14

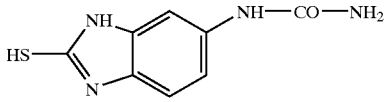

I-15

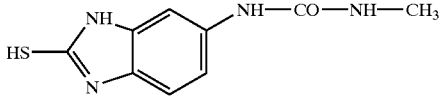

-continued

I-16

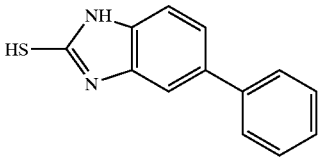

Compounds of formula (I) for use herein can be synthesized in any ordinary methods of chemical synthesis known to those skilled in the art of organic chemistry, for which, for example, referred to is Org. Syn. Col., 4, 569 (1963).

Preferably, 2-mercaptobenzimidazole of formula (I) is added to the emulsion layer of the photothermographic material. The amount of 2-mercaptobenzimidazole of formula (I) to be added falls preferably between $1\times10^{-5}$ mols and $1\times10^{-2}$ mols, more preferably between $1\times10^{-4}$ mols and $2\times10^{-3}$ mols, per mol of silver in the emulsion layer.

In case where the 2-mercaptobenzimidazole of formula (I) is added to a silver halide emulsion which forms the emulsion layer, it may be added thereto in any stage. For example, it may be added to a system where silver halide grains are being formed, or may be added to silver halide grains before, during or after the grains are chemically sensitized, or may be added to a silver halide emulsion just before the emulsion is applied onto a support.

For adding the 2-mercaptobenzimidazole of formula (I) to a silver halide emulsion, employable is any of a method of adding an aqueous solution of the compound to the emulsion; a method of adding an aqueous acidic solution of the compound thereto; a method of adding an aqueous alkaline solution of the compound thereto; a method of adding thereto a solution of the compound in an organic solvent such as methanol or the like; a method of directly adding a powder of the compound thereto; or a method of adding thereto a molecular dispersion of the compound along with gelatin or the like.

Next described is the hexacyano-metal complex of the following general formula (II) (this will be hereinafter referred to as the hexacyano-metal complex for use herein) which exists in the outermost surfaces of the silver halide grains constituting the photothermographic material of the invention.

$$[M(CN)_6]^{n-} \quad \text{(II)}$$

wherein M represents Fe, Ru, Os, Co, Rh, Ir, Cr or Re; and n indicates 3 or 4. Preferably, M is Fe or Ru, more preferably Fe.

Specific examples of the hexacyano-metal complex of formula (II) are mentioned below.

$$[Fe(CN)_6]^{4-} \quad \text{(II-1)}$$

$$[Fe(CN)_6]^{3-} \quad \text{(II-2)}$$

$$[Ru(CN)_6]^{4-} \quad \text{(II-3)}$$

$$[Os(CN)_6]^{4-} \quad \text{(II-4)}$$

$$[Co(CN)_6]^{3-} \quad \text{(II-5)}$$

$$[Rh(CN)_6]^{3-} \quad \text{(II-6)}$$

$$[Ir(CN)_6]^{3-} \quad \text{(II-7)}$$

$$[Cr(CN)_6]^{3-} \quad \text{(II-8)}$$

$$[Re(CN)_6]^{3-} \quad \text{(II-9)}$$

As the hexacyano-metal complex for use herein exists in the form of an ion in an aqueous solution, its counter cation is of no importance. Preferably, the counter cation is any of alkali metal ions such as sodium ion, potassium ion, rubidium ion, cesium ion, lithium ion, etc., ammonium ions, and alkylammonium ions of the following formula (III), as they are readily miscible with water and are suitable for the operation of precipitating silver halide emulsions.

$$[R^1R^2R^3R^4N]^+ \quad \text{(III)}$$

wherein $R^1$, $R^2$, $R^3$ and $R^4$ each independently represent a substituent selected from alkyl groups such as methyl, ethyl, propyl, iso-propyl, n-butyl groups, etc.

In formula (III) indicating alkylammonium ions usable herein, $R^1$, $R^2$, $R^3$ and $R^4$ are preferably the same. For example, preferred are tetramethylammonium, tetraethylammonium, tetrapropylammonium and tetra(n-butyl)ammonium ions.

The hexacyano-metal complex used herein may be added to silver halide grains in the form of a solution thereof in water or in a mixed solvent of water and an organic solvent miscible with water (for example, alcohols, ethers, glycols, ketones, esters, amides, etc.), or in the form of a mixture thereof with gelatin.

The amount of the hexacyano-metal complex to be added preferably falls between $1\times10^{-5}$ mols and $1\times10^{-2}$ mols, more preferably between $1\times10^{-4}$ mols and $1\times10^{-3}$ mols per mol of silver.

In order to make the hexacyano-metal complex exist in the outermost surfaces of silver halide grains, the complex is added to an aqueous silver nitrate solution from which are formed silver halide grains, after the solution has been added to a reaction system to give the grains but before the grains having formed are finished for chemical sensitization such as chalcogen sensitization with sulfur, selenium or tellurium or noble metal sensitization with gold or the like, or is directly added to the grains while they are rinsed or dispersed but before they are finished for chemical sensitization. To prevent the silver halide grains formed from growing too much, it is desirable that the hexacyano-metal complex is added to the grains immediately after they are formed. Preferably, the complex is added thereto before the grains formed are finished for post-treatment.

Adding the hexacyano-metal complex to silver halide grains may be started after 96% by weight of the total of silver nitrate, from which are formed the grains, has been added to a reaction system to give the grains, but is preferably started after 98% by weight of silver nitride has been added thereto, more preferably after 99% by weight thereof has been added thereto.

It is desirable that the hexacyano-metal complex is added to silver halide grains after an aqueous solution of silver nitrate is added to the reaction system to give the grains but just before the grains are completely formed, as the hexacyano-metal complex added in that manner will well adsorb onto the outermost surfaces of the grains formed. Most of the complex added forms a hardly-soluble salt with the silver ions existing in the surfaces of the grains. The silver salt of hexacyano-iron(II) is more hardly soluble than AgI, and fine grains formed are prevented from re-dissolving and aggregating into large grains, so that it has a become possible to produce fine silver halide grains having a small grain size.

The photothermographic material of the invention contains at least one type of photosensitive silver halide grains. For the silver halide grains, used is a photographic silver halide emulsion in which the silver halide grains have a mean grain size falling between 0.005 $\mu$m and 0.1 $\mu$m. These grains will be herein referred to as fine silver halide grains. The grain size of a silver halide grain which is in the form of a cubic or octahedral regular crystal and that of an irregular grain such as a spherical or rod-like grain are meant to indicate the diameter of the sphere having the same volume as that of the grain. Accordingly, the grain size of such regular or irregular grains shall be the sphere-corresponding diameter thereof. On the other hand, the grain size of a tabular silver halide grain is meant to indicate the diameter of the circular image having the same area as that of the projected image of the main surface of the grain. Accordingly, the grain size of such tabular grains shall be the circle-corresponding diameter thereof. The silver halide grains for use in the invention preferably have a mean grain size falling between 0.008 $\mu$m and 0.07 $\mu$m, more preferably between 0.010 $\mu$m and 0.060 $\mu$m. The grain size can be identified through electromicroscopy.

Silver halide grains may have various types of morphology, including, for example, cubic grains, octahedral grains, tabular grains, spherical grains, rod-like grains, potato-like grains, etc. Cubic silver halide grains are preferred for use in the invention. Also preferred are roundish silver halide grains with their corners rounded. The surface index (Miller index) of the outer surface of the photosensitive silver halide grains for use in the invention is not specifically defined, but is desirably such that the proportion of [100] plane, in which the silver ions can readily interact with hexacyano-metal ions, in the outer surface is large. Preferably, the proportion of [100] plane in the outer surface is at least 50%, more preferably at least 65%, even more preferably at least 80%. The Miller index indicated by the proportion of [100] plane can be identified according to a method described by T. Tani in J. Imaging Sci., 29, 165 (1985), based on the adsorption dependency of sensitizing dye onto [111] plane and [100] plane.

The halogen composition of the silver halide grains for use herein is not specifically defined, including, for example, silver chloride, silver chlorobromide, silver bromide, silver iodobromide, silver iodochlorobromide. Regarding the halogen composition distribution in each grain, the composition may be uniform throughout the grain, or may stepwise vary, or may continuously vary. Silver halide grains having a core/shell structure are also preferred for use herein. Preferably, the core/shell structure of the grains has from 2 to 5 layers, more preferably from 2 to 4 layers. A technique of localizing silver bromide on the surface of silver chloride or silver chlorobromide grains is preferably employed herein. The silver iodide content of the emulsion for use herein preferably falls between 0 mol % and 5 mol %.

Silver halide grains having a dislocation line are also preferred for use herein. Grains having a dislocation line are disclosed in U.S. Pat. No. 4,806,461.

The silver halide grains for use herein preferably contain, in its inside, a coordination metal complex having a metal of an element of Groups III to XIV in the Periodic Table or a metal ion of an element of Groups III to XIV in the Periodic Table. The metal of the coordination metal complex and the metal ion may be selected from the elements of Groups III to XIV in the Periodic Table in which element groups are sequenced as Groups I to XVIII from the left. Preferred are metals of the elements of Groups IV, V and VI in the Periodic Table, and more preferred are metals of vanadium, chromium, manganese, iron, cobalt, nickel, niobium, molybdenum, ruthenium, rhodium, palladium, tantalum, tungsten, rhenium, osmium, iridium, platinum, lead. Especially preferred for use herein are iridium complexes. The metals may be used as metal salts of, for example, ammonium salts, acetates, nitrates, sulfates, phosphates, hydroxides, etc. In such a case, the metals are used in the form of their ions. The metals may also be used as monocyclic coordination metal complexes such as 6-coordination metal complexes, 4-coordination metal complexes, etc., or as bis-cored metal complexes or poly-cored metal complexes. Adding such metal complexes to silver halide grains for use herein is preferred, as the grains containing any of them could be favorably modified by the ligands constituting the metal complexes or even by the structures of the complexes. Preferred examples of the ligands for thermal complexes are anionic ligands such as fluoride ions, chloride ions, bromide ions, iodide ions, oxide ions, sulfide ions, selenite ions, telluride ions, cyanide ions, thiocyanide ions, selenocyanide ions, tellurocyanide ions, cyanate ions, nitride ions, azide ions, etc.; neutral ligands such as water, carbonyl, nitrosyl, thionitrosyl, ammonia, etc.; and organic ligands having at least one bond of carbon-carbon, carbon-hydrogen or carbon-nitrogen-hydrogen bonds, for example, 4,4'-bipyridine, pyrazine, thiazole and the like disclosed in U.S. Pat. No. 5,360,712.

Specific examples of these metal ions are described in Comprehensive Coordination Chemistry (Pergamon Press, 1987).

To dope such a coordination metal complex or metal ion into silver halide grains , various methods are employable either singly or as combined. One preferred method comprises directly adding the complex or salt to a reaction system where silver halide grains are formed; and another preferred method comprises adding the complex or salt to a solution that contains halide ions for forming silver halide grains, or to any other solution, followed by adding the resulting solution to a reaction system where the grains are formed. Various methods for addition may be used in combination.

The coordination metal complex or metal ion may be uniformly doped inside the silver halide grains, or alternatively, it may be doped into the grains in such a manner that the surface phase of the grains could have an increased dopant concentration, for example, as in JP-A 208936/1992, 125245/1990 and 188437/1991. Also employable is a method of modifying the surface phase of the grains by physically ripening the grains with doped fine grains, as in U.S. Pat. No. 5,256,530. Preferred is the method that comprises separately preparing doped fine grains followed by adding them to silver halide grains to thereby physically ripen the silver halide grains with the doped fine grains. If desired, the doping methods mentioned above may be combined.

The concentration of the dopant, coordination metal complex or metal ion that may be in silver halide grains for use herein, may be based on one mol of silver in the grains, in the same manner as in ordinary transition metal doping techniques. In this respect, it is known that the dopant concentration can vary in an extremely broad range. For example, the dopant concentration may vary from a low concentration of $10^{-10}$ mols per mol of silver as in JP-A 107129/1976, to a high concentration of $10^{-3}$ mols per mol of silver as in U.S. Pat. Nos. 3,687,676 and 3,690,891. The effective dopant concentration shall significantly vary, depending on the halide content of the grains, the type of coordination metal complex or the metal ion to be selected for the dopant, the oxidation condition of the thus-selected dopant, the type of the ligand, if any, in the dopant, and the desired photographic effect of the doped grains.

The amount of the dopant, coordination metal complex or metal ion having been in silver halide grains, and the degree of doping can be determined through atomic absorption spectrometry, ICP (inductively coupled plasma spectrometry), ICPMS (inductively coupled plasma mass spectrometry) or the like for the doped metal ion.

For the coordination metal complex that may be in silver halide grains for use herein, preferred are hexacyano-metal complexes of a general formula (IV):

$$[M1(CN)_6]^{n1-} \quad \text{(IV)}$$

wherein M1 represents Fe, Ru, Os, Co, Rh, Ir, Cr or Re; and n1 indicates 3 or 4.

Specific examples of the compounds of formula (IV) may be the same as those of formula (II) mentioned above.

The coordination metal complex or metal ion may be added to silver halide grains in the form of a solution thereof in water or in a mixed solvent of water and an organic solvent miscible with water (for example, alcohols, ethers, glycols, ketones, esters, amides, etc.), or in the form of a mixture thereof with gelatin.

To incorporate such a coordination metal complex or metal ion into silver halide grains for use herein, preferably employed is a method comprising directly adding the complex or salt to a reaction system where silver halide grains are formed, or a method comprising adding the complex or salt to an aqueous or other solution that contains halide ions for forming silver halide grains, followed by adding the resulting solution to a reaction system where the grains are formed. Also employable is a method of adding metal ion-doped fine grains to silver halide grains. If desired, the methods mentioned above may be used in combination.

The amount of the coordination metal complex or metal ion to be added to the grains preferably falls between $1\times10^{-8}$ mols and $1\times10^{-3}$ mols, more preferably between $1\times10^{-7}$ mols and $1\times10^{-4}$ mols, per mol of silver.

Regarding the site in which the coordination metal complex or metal ion is doped in the grains, it is desirable that the locally-doped phase in which the coordination metal complex or metal ion concentration is higher by at least 10 times than that in the other site is in the surface area of the grains, and the locally-doped phase in the surface area is at most 50%, more preferably at most 30% by volume of each grain. The epitaxial phase, if grown on the surface of the grains, may be doped with the dopant.

For the metal complex that may be in silver halide grains for use herein, preferred is an iridium complex. The iridium complex is a trivalent or tetravalent iridium complex, including, for example, hexachloroiridate(III), hexachloroiridate(IV), hexabromoiridate(III), hexabromoiridate(IV), hexaiodoiridate(III), hexaiodoiridate (IV), aquapentachloroiridate(III), aquapentachloroiridate (IV), aquapentabromoiridate(III), aquapentabromoiridate (IV), aquapentaiodoiridate(III), aquapentaiodoiridate(IV), diaquatetrachloroiridate(III), diaquatetrachloroiridate(IV), diaquatetrabromoiridate(III), diaquatetrabromoiridate(IV), diaquatetraiodoiridate(III), diaquatetraiodoiridate(IV), triaquatrichloroiridate(III), triaquatrichloroiridate(IV), triaquatribromoiridate(III), triaquatribromoiridate(IV), triaquatriiodoiridate(III), triaquatriiodoiridate(IV), hexammineiridate(III), hexammineiridate(IV), etc. However, the iridium complex usable in the invention is not limited to these examples.

The amount of the iridium complex to be added to the grains preferably falls between $10^{-9}$ mols and $10^{-3}$ mols, more preferably between $10^{-6}$ mols and $10^{-4}$ mols, per mol of halide silver.

Silver halide grains for use herein may be processed for desalting or chemical sensitization, for which referred to are JA-A 84574/1999, paragraphs 0046 to 0050, and JP-A 65021/1999, paragraphs 0025 to 0031.

Photosensitive silver halide grains for use herein are preferably processed by chemical sensitization with, for example, sulfur, selenium or tellurium. Any known compounds are usable for such sulfur, selenium or tellurium sensitization, and, for example, the compounds described in JP-A 128768/1995 are usable for that purpose. To the grains for use herein, especially favorable is tellurium sensitization. Tellurium sensitizers usable herein include, for example, diacyltellurides, bis(oxycarbonyl)tellurides, bis(carbamoyl) tellurides, diacylditellurides, bis(oxycarbonyl)ditellurides, bis(carbamoyl)ditellurides, compounds with P═Te bond, tellurocarboxylates, tellurosulfonates, compounds with P—Te bond, tellurocarbonyl compounds, etc. In particularly, mentioned are the compounds described in JP-A 65021/1999, paragraph 0030. Especially preferred are the compounds of formulae (II), (III) and (IV) given in JP-A 313284/1993.

Preferably, in the invention, the chemical sensitization follows spectral sensitization.

The amount of the sulfur, selenium or tellurium sensitizer for use herein varies, depending on the type of the silver halide grains to be sensitized therewith, the condition for chemically ripening the grains, etc., but may fall generally between $10^{-8}$ and $10^{-2}$ mols, preferably between $10^{-7}$ and $10^{-3}$ mols or so, per mol of the silver halide.

Though not specifically defined herein, the condition for chemical sensitization may be such that the pH falls between 5 and 8, the pAg falls between 6 and 11, preferably between 7 and 10, and the temperature falls between 40 and 95° C., preferably between 44 and 70° C.

The photothermographic material of the invention contains only one type or two or more different types of photosensitive silver halide grains (these will differ in their mean grain size, halogen composition or crystal habit, or in the condition for their chemical sensitization), either singly or in combination. Combination of two or more types of photosensitive silver halide grains differing in their sensitivity will make it possible to control the gradation of the photothermographic material. For the technique relating to it, referred to are JP-A 119341/1982, 106125/1978, 3929/1972, 55730/1973, 5187/1971, 73627/1975, 150841/1982, etc. The sensitivity difference between the combined silver halide grains is preferably such that the respective emulsions differ from each other at least by 0.2 logE.

The amount of the photosensitive silver halide grains to be in the photothermographic material of the invention is, in terms of the amount of silver per $m^2$ of the material, preferably from 0.03 to 0.6 $g/m^2$, more preferably from 0.05 to 0.4 $g/m^2$, most preferably from 0.1 to 0.4 $g/m^2$. The amount of the photosensitive silver halide grains to be in the material preferably falls between 0.01 mols and 0.5 mols, more preferably between 0.02 mols and 0.3 mols, even more preferably between 0.03 mols and 0.25 mols, per mol of the silver salt of an organic acid therein.

Regarding the method and the condition for mixing the photosensitive silver halide grains and a silver salt of an organic acid, each of which has been prepared separately, for example, employable is a method of mixing them in a high-performance stirrer, a ball mill, a sand mill, a colloid mill, a shaking mill, a homogenizer or the like; or a method of adding the photosensitive silver halide grains having been prepared to a silver salt of an organic acid being prepared, in any desired timing to produce the silver salt of an organic acid mixed with the silver halide grains. However, there is no specific limitation thereon, so far as the methods employed ensure the advantages of the invention.

The preferred time at which the photosensitive silver halide grains is added to the coating solution for an image-forming layer may fall between 180 minutes before coating the liquid and a time just before the coating, preferably between 60 minutes before the coating and 10 seconds before it. However, there is no specific limitation thereon, so far as the method and the condition employed for adding the grains to the coating solution ensure the advantages of the invention. As a method of mixing, employable is a method of adding the grains to the coating solution in a tank in such a controlled manner that the mean residence time for the grains in the tank, as calculated from the amount of the grains added and the flow rate of the coating solution to a coater, could be a predetermined period of time; or a method of mixing them with a static mixer, for example, as in N. Harunby, M. F. Edwards & A. W. Nienow's Liquid Mixing Technology, Chap. 8 (translated by Koji Takahasi, published by Nikkan Kogyo Shinbun, 1989).

The photothermographic material of the invention contains a non-photosensitive silver salt of an organic acid. The silver salt of an organic acid for use herein is relatively stable to light, but, when heated at 80° C. or higher in the presence of an exposed photocatalyst (e.g., latent image of photosensitive silver halide, etc.) and a reducing agent, it forms a silver image. The silver salt of an organic acid may be any and every organic substance that contains a source capable of reducing silver ions. Such non-photosensitive silver salt of an organic acid of that type are described, for example, in JP-A 62899/1998, paragraphs 0048 to 0049, and in European Patent Laid-Open No. 0803763A1, from page 18 line 24 to page 19, line 37. Preferred for use herein are silver salts of organic acids, especially silver salts of long-chain (C10 to C30, preferably C15 to C28) aliphatic carboxylic acids. Preferred examples of the silver salt of an organic acid are silver behenate, silver arachidate, silver stearate, silver oleate, silver laurate, silver caproate, silver myristate, silver palmitate, silver maleate, silver fumarate, silver tartrate, silver linolate, silver butyrate, silver camphorate, and their mixtures.

The silver salt of an organic acid for use herein is not specifically defined for its morphology, but is preferably scaly. Scaly silver salt of an organic acids are herein defined as follows: A sample of a silver salt of an organic acid to be analyzed is observed with an electronic microscope, and the grains of the salt seen in the field are approximated to rectangular parallelopipedons. The three different edges of the thus-approximated, one rectangular parallelopipedone are represented by a, b and c. a is the shortest, c is the longest, and c and b may be the same. From the shorter edges a and b, x is obtained according to the following equation:

$$x=b/a.$$

About 200 grains seen in the field are analyzed to obtain the value x, and the data of x are averaged. Samples that satisfy the requirement of x (average)≧1.5 are scaly. For scaly grains, preferably, 30≧x (average)≧1.5, more preferably 20≧x (average)≧2.0. In this connection, the value x of acicular (needle-like) grains falls within a range of 1≦x (average)<1.5.

In scaly grains, it is understood that a corresponds to the thickness of tabular grains of which the main plane is represented by b×c. In scaly grains of the silver salt of an organic acid for use herein, a (average) preferably falls between 0.01 μm and 0.23 μm, more preferably between 0.1 μm and 0.20 μm; and c/b (average) preferably falls between 1 and 6, more preferably between 1.05 and 4, even more preferably between 1.1 and 3, still more preferably between 1.1 and 2.

Regarding its grain size distribution, the silver salt of an organic acid is preferably a mono-dispersed one. Mono-dispersion of grains referred to herein is such that the value (in terms of percentage) obtained by dividing the standard deviation of the minor axis and the major axis of each grain by the minor axis and the major axis thereof, respectively, is preferably at most 100%, more preferably at most 80%, even more preferably at most 50%. To determine its morphology, a dispersion of the silver salt of an organic acid may be analyzed on its image taken by the use of a transmission electronic microscope. Another method for analyzing the silver salt of an organic acid for mono-dispersion morphology comprises determining the standard deviation of the volume weighted mean diameter of the salt grains. In the method, the value in terms of percentage (coefficient of variation) obtained by dividing the standard deviation by the volume weighted mean diameter of the salt grains is preferably at most 100%, more preferably at most 80%, even more preferably at most 50%. Concretely, for example, a sample of the silver salt of an organic acid is dispersed in a liquid, the resulting dispersion is exposed to a laser ray, and the self-correlation coefficient of the salt grains relative to the time-dependent change of the degree of fluctuation of the scattered ray is obtained. Based on this, the grain size (volume weighted mean diameter) of the salt grains is obtained.

Silver salts of organic acids for use herein can be prepared by reacting a solution or suspension of an alkali metal salt (e.g., Na, K or Li salt) of an organic acid as mentioned hereinabove with silver nitrate. The alkali metal salt of an organic acid can be obtained by treating an organic acid with an alkali. Preparation of such silver salts of organic acids may be effected in any batch wise or continuous mode in any desired reactor. The reactants in the reactor may be stirred in any desired stirring mode, depending on the necessary properties of the grains to be formed. Concretely, for preparing silver salts of organic acids for use herein, employable is any of a method of gradually or rapidly adding an aqueous solution of silver nitrate to a reactor that contains therein a solution or suspension of an alkali metal salt of an organic acid; a method of gradually or rapidly adding a solution or suspension of an alkali metal salt of an organic acid having been previously prepared, to a reactor that contains therein an aqueous solution of silver nitrate; or a method of putting an aqueous solution of silver nitrate and a solution or suspension of an alkali metal salt of an organic acid both having been prepared previously and separately, into a reactor at the same time. Any of these methods are preferably employed herein.

The aqueous solution of silver nitrate and the solution or suspension of an alkali metal salt of an organic acid will have any desired concentration for controlling the grain size of the silver salt of the organic salt. The flow rate of the solution or suspension may be any desired one. For example, for mixing the aqueous solution of silver nitrate with the solution or suspension of an alkali metal salt of an organic acid, employable is any of a method of mixing the two at a predetermined constant flow rate; or an accelerated or decelerated flow rate method in which the flow rate of the two is time-dependently varied in any desired manner. One reactant liquid may be added to the other in a reactor, above or into the liquid in the reactor. In the method where an aqueous solution of silver nitrate and a solution or suspension of an alkali metal salt of an organic acid both having been prepared previously and separately are simultaneously put into a reactor, any one of the aqueous solution of silver nitrate or the solution or suspension of an alkali metal salt of an organic acid may be first put into the reactor prior to the other, but it is preferable that the aqueous solution of silver nitrate is first put thereinto. In the preferred case, it is desirable that from 0 to 50% by volume, more preferably from 0 to 25% by volume of the total amount of the aqueous solution of silver nitrate to be reacted is first put into the reactor prior to other salt solution or suspension. Also preferably, the reactants are mixed while the pH or the silver potential of the resulting mixture being reacted is controlled, for example, as in JP-A 127643/1997.

The pH of the aqueous solution of silver nitrate and the solution or suspension of an alkali metal salt of an organic acid to be put into a reactor can be controlled, depending on the necessary properties of the grains of the silver salt of an organic acid to be formed from them. For controlling their pH, for example, any desired acid or alkali may be added to the reaction system. Also depending on the necessary properties of the grains, for example, the temperature of the reaction mixture in a reactor may be set at any desired one for controlling the grain size of the grains of the silver salt of an organic acid being formed therein. If desired, the temperature of the aqueous solution of silver nitrate and the solution or suspension of an alkali metal salt of an organic acid to be put into a reactor may also be set at any desired one. Preferably, the solution or suspension of an alkali metal salt of an organic acid is kept heated at 50° C. or higher in order that it can be fluid.

Preferably, the silver salt of an organic acid for use herein is prepared in the presence of a tertiary alcohol. It is desirable that the tertiary alcohol has at most 15 carbon atoms in total, more preferably at most 10 carbon atoms. One preferred example of the tertiary alcohol is tert-butanol. The tertiary alcohol may be added to the reaction system in any desired time while the silver salt of an organic acid is prepared. Preferably, however, it is added thereto while an alkali metal salt of an organic acid is prepared so that it can dissolve the metal salt prepared therein. The amount of the tertiary alcohol to be added may vary, for example, falling between 0.01 and 10 times by weight of water as the solvent for the preparation of silver salt of an organic acid, more preferably between 0.03 and 1 time by weight of the solvent.

Preferably, the scaly silver salt of an organic acid for use in the invention is prepared by reacting an aqueous solution of a water-soluble silver salt with an aqueous solution of an alkali metal salt of an organic acid in a tertiary alcohol in a reactor. The method includes a step of adding the aqueous solution of an alkali metal salt of an organic acid in a tertiary alcohol to a liquid already existing in a reactor. In the method, it is desirable that the temperature difference between the liquid already existing in the reactor and the aqueous solution of an alkali metal salt of an organic acid in a tertiary alcohol to be added thereto falls between 20° C. and 85° C. The liquid existing in the reactor in the method is preferably an aqueous solution of a water-soluble silver salt having been previously put into the reactor. In case where the aqueous solution of a water-soluble silver salt is not previously put into the reactor but is put thereinto along with an aqueous solution of an alkali metal salt of an organic acid in a tertiary alcohol, the liquid existing in the reactor is water or a mixed solvent of water and a tertiary alcohol, as will be mentioned hereinunder. Even in case where the aqueous solution of a water-soluble silver salt is previously put into the reactor, the reactor may contain water or a mixed solvent of water and a tertiary alcohol.

With the temperature difference between the liquid already existing in the reactor and the aqueous solution of an alkali metal salt of an organic acid in a tertiary alcohol to be added thereto being controlled to fall within the defined range, the crystal morphology of the silver salt of an organic acid to be formed could be well controlled.

The water-soluble silver salt is preferably silver nitrate. The concentration of the water-soluble silver salt in the aqueous solution preferably falls between 0.03 mols/liter and 6.5 mols/liter, more preferably between 0.1 mols/liter and 5 mols/liter. Also preferably, the pH of the aqueous solution falls between 2 and 6, more preferably between 3.5 and 6.

The aqueous solution of a water-soluble silver salt may contain a tertiary alcohol having from 4 to 6 carbon atoms. The amount of the tertiary alcohol, if any, in the aqueous solution may be at most 70% by volume, but preferably at most 50% by volume of the overall volume of the aqueous solution. The temperature of the aqueous solution preferably falls between 0° C. and 50° C., more preferably between 5° C. and 30° C. In case where the aqueous solution of a water-soluble silver salt and the aqueous solution of an alkali metal salt of an organic acid in a tertiary alcohol are simultaneously put into a reactor as in the manner to be mentioned below, the temperature of the two solutions falls most preferably between 5° C. and 15° C.

Specifically, the alkali metal for the alkali metal salt of an organic acid is Na or K. The alkali metal salt of an organic acid may be prepared by adding NaOH or KOH to an organic acid. In this step, it is desirable that the amount of the alkali to be added to an organic acid is not larger than the equimolar amount of the organic acid so that the non-reacted organic acid could remain in the reaction mixture. In the preferred case, the amount of the remaining non-reacted organic acid may fall between 3 mol % and 50 mol %, but preferably between 3 mol % and 30 mol %, per mol of the organic acid added to the reaction system. If desired, after a larger amount of the alkali than an intended amount thereof is added to the reaction system, and thereafter an additional acid such as nitric acid, sulfuric acid or the like is added thereto to thereby neutralize the excess alkali in the system.

Depending on the necessary properties of the silver salt of an organic acid to be formed, the pH of the reaction system for the salt may be controlled. For controlling the pH, any acid or alkali may be added to the reaction system.

To the aqueous solution of a water-soluble silver salt, or the aqueous solution of an alkali metal salt of an organic acid in a tertiary alcohol, or even to the liquid previously existing in the reactor, if desired, optionally added are any of compounds of formula (1) described in JP-A 65035/1987, water-soluble group-containing N-heterocyclic compounds such as those described in JP-A 150240/1987, inorganic peroxides such as those described in JP-A 101019/1975, sulfur compounds such as those described in JP-A 78319/1976, disulfide compounds such as those described in JP-A 643/1982, hydrogen peroxide or the like.

The aqueous solution of an alkali metal salt of an organic acid in a tertiary alcohol is preferably in a mixed solvent of water and a tertiary alcohol having from 4 to 6 carbon atoms for ensuring the uniformity of the solution. Alcohols in which the number of carbon atoms oversteps the defined range are unfavorable as their miscibility with water is poor. Among the tertiary alcohol having from 4 to 6 carbon atoms, most preferred is tert-butanol as its miscibility with water is the highest of all. Alcohols other than such tertiary alcohols are also unfavorable since they are reducible and will have some negative influences on the process of forming the intended silver salts of an organic acid, as so mentioned hereinabove. The amount of the tertiary alcohol that may be additionally in the aqueous solution of an alkali metal salt of an organic acid in a tertiary alcohol may fall between 3% by volume and 70% by volume, but preferably between 5% by volume and 50% by volume, relative to the volume of water in the aqueous solution.

The concentration of the alkali metal of an organic acid in the aqueous solution thereof in a tertiary alcohol may fall between 7% by weight and 50% by weight, but preferably between 7% by weight and 45% by weight, more preferably between 10% by weight and 40% by weight.

The temperature of the aqueous solution of such an alkali metal salt of an organic acid in a tertiary alcohol to be put into a reactor preferably falls between 50° C. and 90° C., more preferably between 60° C. and 85° C., most preferably between 65° C. and 85° C., in order that the alkali metal salt of an organic acid in the solution is kept prevented from being crystallized or solidified. For constantly controlling the predetermined reaction temperature, it is desirable that the temperature of the aqueous solution is controlled to fall within the defined range.

The silver salt of an organic acid preferred for use in the invention may be prepared according to i) a method of first putting the overall amount of an aqueous solution of a water-soluble silver salt into a reactor, followed by adding thereto an aqueous solution of an alkali metal salt of an organic acid in a tertiary alcohol (single addition method), or ii) a method of simultaneously putting both an aqueous solution of a water-soluble silver salt and an aqueous solution of an alkali metal salt of an organic acid in a tertiary alcohol into a reactor at least any time while the two are mixed in the reactor (simultaneous addition method). In the invention, the latter simultaneous addition method is preferred, since the mean grain size of the silver salt of an organic acid produced can be well controlled and since the grain size distribution thereof can be narrowed. In this method, it is desirable that at least 30% by volume, more preferably from 50 to 75% by volume of the total amount of the two is simultaneously put in to the reactor. In case where any one of the two is previously put into the reactor, it is desirable that the solution of a water-soluble silver salt is first put thereinto.

In any case, the temperature of the liquid previously existing in the reactor (the liquid is the aqueous solution of a water-soluble silver salt having been previously put into the reactor as in the manner mentioned above; or in case where the aqueous solution of a water-soluble silver salt is not previously put into the reactor, the liquid is a solvent having been previously put thereinto as in the manner to be mentioned hereinunder) preferably falls between 5° C. and 75° C., more preferably between 5° C. and 60° C., most preferably between 10° C. and 50° C. Throughout the entire process of the reaction, the reaction temperature is preferably controlled to fall within the defined range. The reaction temperature may be controlled in some temperature profiles all varying within the defined range.

The temperature difference between the liquid already existing in the reactor and the aqueous solution of an alkali metal salt of an organic acid in a tertiary alcohol to be added thereto preferably falls between 20° C. and 85° C., more preferably between 30° C. and 80° C. In this case, it is desirable that the temperature of the aqueous solution of an alkali metal salt of an organic acid in a tertiary alcohol is higher than that of the liquid already existing in the reactor.

Accordingly, the rate at which the aqueous solution of an alkali metal salt of an organic acid in a tertiary alcohol having a higher temperature is rapidly cooled in a reactor and precipitated to give fine crystals, and the rate at which the thus-deposited alkali metal salt is reacted with the water-soluble silver salt added thereto to give the intended silver salt of an organic acid, are both well controlled, and therefore the crystal morphology of the silver salt of an organic acid formed, the crystal size thereof and the crystal size distribution thereof are all favorably controlled. In addition, the performances of the thermally processed material, especially the photothermographic material containing the thus-controlled silver salt of an organic acid, can be improved.

The reactor may previously contain a solvent therein, and the solvent is preferably water, but may also be a mixed solvent of water and a tertiary alcohol such as that mentioned above.

To the aqueous solution of an alkali metal salt of an organic acid in a tertiary alcohol or the aqueous solution of a water-soluble silver salt, or to the reaction mixture in the reactor, optionally added is a dispersant (dispersing aid) which is soluble in aqueous media. The dispersant may be any one capable of dispersing the silver salt of an organic acid formed. For its examples, referred to are those which will be mentioned hereinafter for the dispersant for silver salts of an organic acid.

In the process of producing silver salts of an organic acid for use herein, the salts formed are preferably desalted and dewatered. The method for desalting and dewatering the salts is not specifically defined, and they may be processed in any known ordinary manner. For example, preferred is known filtration including centrifugation, suction filtration, ultrafiltration, flocculation followed by washing in water, etc. Also preferred is supernatant removal through centrifugal precipitation. Desalting and dewatering may be effected in one stage or may be repeated. Adding water to the reaction system and removing it from the system may be effected continuously or separately. Desalting and dewatering is preferably effected to such a degree that the finally removed water could have a conductivity of at most 300 $\mu$s/cm, more preferably at most 100 $\mu$s/cm, most preferably at most 60 $\mu$s/cm. For this, the lowermost limit of the conductivity of the removed water is not specifically defined, but may be generally 5 $\mu$s/cm or so.

To improve the photothermographic material that contains the silver salt of an organic acid, especially the condition of the coated surface of the material, the silver salt of an organic acid formed is preferably further processed in a process comprising dispersing it in water, forming a high-pressure high-speed jet stream of the resulting aqueous dispersion, and re-dispersing the salt by de-pressurizing the jet stream to give a fine aqueous dispersion of the salt. In this case, the dispersant is preferably water alone, but may contain an organic solvent of which, however, the amount is limited to at most 20% by weight of the dispersant.

According to the process of finely dispersing the silver salt of an organic acid, for example, the silver salt of an organic acid is mechanically dispersed in the presence of a dispersant, for which is used any known dispersing means (e.g., high-performance mixer, homogenizer, high-performance impact mill, Banbury mixer, homo-mixer, kneader, ball mill, shaking ball mill, planetary ball mill, attritor, sand mill, bead mill, colloid mill, jet mill, roller mill, trommel mill, high-performance stone mill).

It is desirable that the silver salt of an organic acid is dispersed substantially in the absence of a photosensitive silver salt, since if the photosensitive silver salt exists in the dispersing system, fog will be increased and sensitivity will be significantly lowered. For the photothermographic material of the invention, the amount of the photosensitive silver salt that may be in the aqueous dispersion of the silver salt of an organic acid shall be at most 0.1 mol % relative to one mol of the silver salt of an organic acid, and any photosensitive silver salt is not forcedly added to the aqueous dispersion.

The silver salt of an organic acid serves as an image-forming medium in the photothermographic material of the invention. In order to obtain a uniform dispersion of a solid silver salt of an organic acid capable of having an increased ratio of S/N and a reduced grain size and capable of being uniform with no coagulation, it is desirable that, while the salt is dispersed, great force is uniformly applied thereto to such a degree that the grains of the salt are neither damaged nor heated by such great force. For this, the process as above is preferred, which comprises forming a high-speed jet stream of an aqueous dispersion of the silver salt of an organic acid in an aqueous dispersant followed by de-pressurizing the jet stream.

The details of the apparatus and the technology for the re-dispersing process are described, for example, in Rheology of Dispersion System and Dispersion Technology (by Toshio Kajiuchi & Hiromoto Usui, pp. 357–403, 1991; Shinzan-sha Publishing); Progress in Chemical Engineering, 24th Ed. (by Corporation Chemical Engineering Society, Tokai Branch, pp. 184–185, 1990, Maki Shoten Publishing); JP-A 49832/1984, U.S. Pat. No. 4,533,254, JP-A 137044/1996, 238848/1996, 261525/1990, 94933/1989, etc. The re-dispersing process for the invention comprises at least forcedly introducing an aqueous dispersion that contains a silver salt of an organic acid into a pipe line via a high-pressure pump or the like, making the resulting jet stream of the dispersion pass through a narrow slit provided inside the pipe line, and thereafter rapidly de-pressurizing the jet stream to thereby further finely dispersing the grains of the salt in the resulting dispersion.

For high-pressure homogenizers usable in the invention, it is considered that fine and uniform dispersion can be achieved therein generally by enhancing the dispersion force such as (a) "shear force" to be generated at the passage of a dispersoid through a narrow slit (75 $\mu$m to 350 $\mu$m or so) under high pressure at high speed and (b) "cavitation force" to be generated by de-pressurizing the stream having passed through the slit, for which, however, the impact force resulting from the liquid-liquid collision or the liquid-wall collision in the high-pressure narrow space is not varied. One example of the dispersion apparatus of this type is a Golline homogenizer well known in the art. Its mechanism is as follows: A liquid to be dispersed is introduced into it under high pressure, and formed into a high-speed jet stream after having passed through a narrow slit formed through the wall of the inner cylinder unit therein. Then, the jet stream collides against the wall around the cylinder unit with great force, and is therefore emulsified and dispersed owing to the impact force of itself. For the liquid-liquid collision mentioned above, for example, referred to is a Y-type chamber of a micro-fluidizer, a spherical chamber provided with a spherical check valve such as that in JP-A 103642/1996 (this will be described hereinunder) or the like; and for the liquid-wall collision, referred to is a Z-type chamber of a micro-fluidizer or the like. The pressure generally falls between 100 and 600 kg/cm$^2$; and the flow rate generally falls between a few meters/sec and 30 meters/sec. In order to increase the dispersion efficiency, some devices are designed wherein the high flow rate area is so modified as to have a serrated configuration, thereby increasing the frequency of collision. Typical examples of such devices are Golline homogenizers, Microfluidex International Corporation's micro-fluidizers, Mizuho Industry's micro-fluidizers, Tokushu Kika Kogyo's nanomizers, etc. Other examples are described in JP-A 238848/1996, 103642/1996, and U.S. Pat. No. 4,533,254.

In the process of dispersing it, the silver salt of an organic acid can be dispersed into grains having a desired grain size profile by controlling its flow rate, the pressure difference in the step of de-pressurizing the jet stream, and the frequency of the treatment. In view of the photographic properties and the grain size of the salt, it is preferred that the flow rate falls between 200 m/sec and 600 m/sec, and the pressure difference in the step of de-pressurizing the jet stream falls between 900 and 3000 kg/cm$^2$, and it is more preferred that the flow rate falls between 300 m/sec and 600 m/sec; and the pressure difference in the step of de-pressurizing the jet stream falls between 1500 and 3000 kg/cm$^2$. The frequency of the dispersion treatment may be suitably determined, but falls between 1 and 10 times, preferably between 1 and 3 times or so in view of the productivity. Heating the aqueous dispersion to a high temperature under high pressure is unfavorable, as detracting from the dispersibility and the photographic properties of the silver salt of an organic acid. At higher temperatures than 90° C., the grains of the salt will be too large, and will be much fogged. Accordingly, it is desirable that the salt dispersion being processed is cooled before it is formed into a high-pressure high-speed jet stream and/or after its jet stream is de-pressurized. Being so cooled, the salt dispersion is preferably kept at a temperature falling between 5° C. and 90° C., more preferably between 5° C. and 80° C., even more preferably between 5° C. and 65° C. while it is processed. In particular, while the salt dispersion is under a high pressure falling between 1500 and 3000 kg/cm$^2$, cooling process is effective. Depending on the necessary heat exchange capacity, the cooling device to be used may be any of a double-walled or three-walled static mixer, a multi-tubular heat exchanger, a bellows-like heat exchanger, etc. To increase its heat exchange efficiency, the cooling device may be designed in any desired manner with respect to the size, the wall thickness and the material of the tubular unit. In designing it, the pressure to be applied thereto should be taken into consideration. Also depending on the necessary heat exchange capacity, the coolant for the cooling device shall be determined. For example, it may be tap water at 20° C., or cold water cooled in a refrigerator to be at 5 to 10° C. As the case may be, a coolant of ethylene glycol/water at −30° C. may be used.

When the silver salt of an organic acid is dispersed in the presence of a dispersant to give a dispersion of its fine solid grains, some additive may be added thereto. The additive includes, for example, synthetic anionic polymers such as polyacrylic acids, acrylic acid copolymers, maleic acid copolymers, monomaleate copolymers, acryloylmethylpropanesulfonic acid copolymers, etc.; semi-synthetic anionic polymers such as carboxymethyl starch, carboxymethyl cellulose, etc.; anionic polymers such as alginic acid, pectic acid, etc.; anionic surfactants such as those described in JP-A 92716/1977, International Patent Publication No. W088/04794, etc.; compounds described in JP-A 179243/1997; as well as other known anionic, nonionic and cationic surfactants, other known polymers such as polyvinyl alcohol, polyvinylpyrrolidone, carboxymethyl cellulose, hydroxypropyl cellulose, hydroxypropylmethyl cellulose, etc., naturally existing polymer compounds such as gelatin, etc.

In general, a dispersant is added to and mixed with non-dispersed powder or wet cake of the silver salt of an organic acid, and the resulting slurry is fed into a dispersing apparatus. Apart from this, the silver salt of an organic acid may be, after having been mixed with a dispersant, heated or processed with a solvent to give powder or wet cake of the mixture. Before, during or after the dispersing step, some pH controlling agent may be added to the system to thereby control the pH of the resulting dispersion.

Other than the mode of mechanical dispersion, the silver salt of an organic acid can be made into micrograms by roughly dispersing it in a solvent through pH control, and then changing the pH of the system in the presence of a dispersant. For this, the solvent may be an organic solvent, and, in general, it is finally removed from the micrograms dispersion formed.

The salt dispersion prepared in the manner as above can be stored with stirring to prevent precipitation of the grains in storage, or stored in the form of a viscous liquid with a hydrophilic colloid added thereto (for example, in the form of jelly with gelatin). In order to prevent it from being contaminated with microorganisms in storage, a preservative may be added to the salt dispersion.

It is desirable that the silver salt of an organic acid prepared is, after dispersed in an aqueous solvent, mixed with an aqueous solution of a photosensitive silver salt, and the resulting mixture serves as a coating solution for forming a photosensitive image-forming medium.

Prior to being finely dispersed, the stock liquid of the silver salt of an organic acid is roughly dispersed (this is a pre-dispersing step). For roughly dispersing it, usable is any known dispersing device (e.g., high-performance mixer, homogenizer, high-performance impact mill, Banbury mixer, homo-mixer, kneader, ball mill, shaking ball mill, planetary ball mill, attritor, sand mill, bead mill, colloid mill, jet mill, roller mill, trommel mill, high-performance stone mill). Other than the mode of mechanical dispersion, the stock liquid can be processed by roughly dispersing it in a solvent through pH control, and then changing the pH of the system in the presence of a dispersant to thereby form fine grains of the salt in the resulting dispersion. For this, the solvent may be an organic solvent, and, in general, it is finally removed from the fine salt dispersion formed.

The fine dispersion of the silver salt of an organic acid is mixed with an aqueous solution of a photosensitive silver salt, and the resulting mixture serves as a coating solution for forming a photosensitive image-forming medium. Photothermographic materials produced by applying the coating solution onto a support have the advantages of low haze, low fog and high sensitivity. On the contrary, if a photosensitive silver salt is added to the silver salt of an organic acid before the silver salt of an organic acid is formed into a high-pressure high-speed jet stream in the process of forming the salt into its fine dispersion, and if the resulting salt dispersion is used in producing photothermographic materials, the materials are fogged and their sensitivity will be significantly low. In addition, if an organic solvent and not water is used as the dispersion medium for the coating solution, the photothermographic materials produced are often fogged and their sensitivity will be low. On the other hand, if a different method of partly converting the silver salt of an organic acid in the dispersion into a photosensitive silver salt (this is referred to as a conversion method) is employed in place of the method of adding an aqueous solution of a photosensitive silver salt to the dispersion of a silver salt of an organic acid, the sensitivity of the photothermographic materials produced will be also low.

In the process mentioned above, the aqueous dispersion of the silver salt of an organic acid prepared through the step of forming a high-pressure high-speed jet stream contains substantially no photosensitive silver salt, and the amount of the photosensitive silver salt in the dispersion shall be at most 0.1 mol % relative to one mol of the non-photosensitive silver salt of an organic acid therein. Any photosensitive silver salt is not forcedly added to the aqueous dispersion of the silver salt of an organic acid.

The grain size (in terms of the volume weighted mean diameter) of dispersed solid grains of the silver salt of an organic acid can be obtained, for example, as follows: A sample of the solid grain dispersion in liquid is exposed to a laser ray, and the self-correlation coefficient of the dispersed grains relative to the time-dependent change of the degree of fluctuation of the scattered ray is obtained. Based on this, the grain size (volume weighted mean diameter) of the salt grains is obtained. Preferably, the salt dispersion for use herein has a mean grain size falling between 0.05 $\mu$m and 10.0 $\mu$m. more preferably between 0.1 $\mu$m and 5.0 $\mu$m, even more preferably between 0.1 $\mu$m and 2.0 $\mu$m.

The dispersion of solid grains of a silver salt of an organic acid preferred for use in the invention comprises at least the silver salt of an organic acid and water. In this, the ratio of the silver salt of an organic acid to water is not specifically defined, but the proportion of the silver salt of an organic acid to the total of the dispersion preferably falls between 5 and 50% by weight, more preferably between 10 and 30% by weight. Adding the dispersant mentioned above to the salt dispersion is preferred, but it is desirable that the amount of the dispersant to be in the dispersion is minimized within a range within which the dispersant is effective for minimizing the grain size of the salt grains. The range of the dispersant is from 1 to 30% by weight, preferably from 3 to 15% by weight of the silver salt of an organic acid.

To prepare the coating solution for the photothermographic material of the invention, the aqueous dispersion of the silver salt of an organic acid is mixed with an aqueous dispersion of a photosensitive silver salt. For this, the mixing ratio of the photosensitive silver salt to the silver salt of an organic acid may vary, depending on the object of the invention. Preferably, the ratio falls between 1 and 30 mol %, more preferably between 3 and 20 mol %, even more preferably between 5 and 15 mol %. Mixing two or more different types of aqueous dispersion of a silver salt of an organic acid, and two or more different types of aqueous, photosensitive silver salt dispersions is preferred for controlling the photographic properties of the resulting mixture.

The amount of the silver salt of an organic acid to be in the photothermographic material of the invention is not specifically defined, and may be any desired one. Preferably, the amount of the salt falls between 0.1 and 5 g/m$^2$, more preferably between 1 and 3 g/m$^2$, in terms of the amount of silver in the salt.

The photothermographic material of the invention contains a reducing agent for the silver salt of an organic acid therein. The reducing agent for the silver salt of an organic acid may be any and every substance capable of reducing silver ions into silver, but is preferably an organic substance. Examples of the reducing agent are described in JP-A 65021/1999, paragraphs 0043 to 0045 and in European Patent Laid-Open No. 0803764A1, from page 7, line 34 to page 18, line 12. Especially preferred for use herein are bisphenol-type reducing agents (e.g., 1,1-bis(2-hydroxy-3,5-dimethylphenyl)-3,5,5-trimethylhexane). Preferably, the amount of the reducing agent to be in the material falls between 0.01 and 5.0 g/m$^2$, more preferably between 0.1 and 3.0 g/m$^2$. Also preferably, the amount of the reducing agent to be therein falls between 5 and 50 mol %, more preferably between 10 and 40 mol %, per mol of silver in the side of the image-forming layer of the material. Still preferably, the reducing agent is present in the image-forming layer of the material.

The reducing agent for use in the invention is preferably in the form of a dispersion of fine solid grains of the agent, and the fine dispersion is incorporated into the photothermographic material. The fine dispersion of the reducing agent may be prepared in any known means (e.g., ball mill, shaking ball mill, sand mill, colloid mill, jet mill, roller mill, etc.). A dispersant may be used in preparing the fine dispersion.

Next described is the binder for use in the invention.

One preferred embodiment of producing the photothermographic material of the invention comprises applying a coating solution, in which the solvent contains at least 30% by weight of water, onto a support to form a silver salt of an organic acid-containing layer thereon, followed by drying the layer. In this, it is desirable that the binder in the silver salt of an organic acid-containing layer is soluble or dispersible in an aqueous solvent (e.g., water). More desirably, the binder is a polymer latex having an equilibrium water content at 25° C. and relative humidity of 60%, of at most 2% by weight. The photothermographic material produced according to the preferred embodiment has better photographic properties. Most preferably, the polymer latex is so controlled as to have an ion conductivity of at most 2.5 mS/cm. To prepare the polymer latex of the preferred type, for example, a polymer produced through chemical synthesis is purified through a fractionating membrane.

The aqueous solvent in which the polymer binder is soluble or dispersible is water or a mixed solvent of water and at most 70% by weight of a water-miscible organic solvent. The water-miscible organic solvent includes, for example, alcohols such as methyl alcohol, ethyl alcohol, propyl alcohol, etc.; cellosolves such as methyl cellosolve, ethyl cellosolve, butyl cellosolve, etc.; ethyl acetate, dimethylformamide, etc.

The terminology "aqueous solvent" referred to herein can apply also to polymer systems in which the polymer is not thermodynamically dissolved but is dispersed.

The "equilibrium water content at 25° C. and relative humidity of 60% " referred to herein for polymer latex is represented by the following equation, in which W1 indicates the weight of a polymer in humidity-conditioned equilibrium at 25° C. and relative humidity of 60%, and WO indicates the absolute dry weight of the polymer at 25° C.

Equilibrium water content at 25° C. and relative humidity of 60%

$$=[(W1-W0)/W0]\times 100(\%\text{ by weight})$$

For the details of the definition of water content and the method for measuring it, for example, referred to is High Polymer Engineering, Lecture 14, Test Methods for High Polymer Materials (by the High Polymer Society of Japan, Chijin Shokan Publishing).

Preferably, the equilibrium water content at 25° C. and relative humidity of 60% of the binder polymer for use herein is at most 2% by weight, more preferably from 0.01 to 1.5% by weight, even more preferably from 0.02 to 1% by weight.

Polymers for use herein are preferably dispersible in aqueous solvents.

Polymer dispersions include, for example, a type of polymer latex where fine solid grains of polymer are dispersed, and a type of molecular or micellar polymer dispersion where polymer molecules or micelles are dispersed. Any of them is preferred for use herein.

In preferred embodiments of the photothermographic material of the invention, favorably used are hydrophobic polymers such as acrylic resins, polyester resins, rubber resins (e.g., SBR resins), polyurethane resins, polyvinyl chloride resins, polyvinyl acetate resins, polyvinylidene chloride resins, polyolefin resins, etc. The polymers for use herein may be linear, branched or crosslinked ones. The polymers may be homopolymers from one type of monomer, or copolymers from two or more different types of monomers. The copolymers may be random copolymers or block copolymers. The polymers for use herein may have a number-average molecular weight falling between 5000 and 1000000, preferably between 10000 and 200000. Polymers having a too small molecular weight are unfavorable to the invention, since the mechanical strength of their emulsion layers is low; but others having a too large molecular weight are also unfavorable since their workability into films is not good.

The "aqueous solvent" referred to herein indicates a dispersion medium of which at least 30% by weight is water. The polymer dispersion usable herein may be in any condition, including, for example, emulsion dispersion, micellar dispersion, and also molecular dispersion of polymer having a hydrophilic moiety in the molecule, etc. Above all, polymer latex is especially preferred for use herein.

Preferred examples of polymer latex for use herein are mentioned below. They are expressed by the constituent monomers, in which each numeral parenthesized indicates the proportion, in terms of % by weight, of the monomer unit. The molecular weight is number-average molecular weight.

P-1: Latex of -MMA(70)-EA(27)-MAA(3)-(molecular weight: 37000)

P-2: Latex of -MMA(70)-2EHA(20)-St(5)-AA(5)-(molecular weight: 40000)

P-3: Latex of -St(50)-Bu(47)-MMA(3)-(molecular weight: 45000)

P-4: Latex of -St(68)-Bu(29)-AA(3)-(molecular weight: 60000)

P-5: Latex of -St(70)-Bu(27)-IA(3)-(molecular weight: 120000)

P-6: Latex of -St(75)-Bu(24)-AA(1)-(molecular weight: 108000)

P-7: Latex of -St(60)-Bu(35)-DVB(3)-MAA(2)-(molecular weight: 150000)

P-8: Latex of -St(70)-Bu(25)-DVB(2)-AA(3)-(molecular weight: 280000)

P-9: Latex of -VC(50)-MMA(20)-EA(20)-AN(5)-AA(5)-(molecular weight: 80000)

P-10: Latex of -VDC(85)-MMA(5)-EA(5)-MAA(5)-(molecular weight: 67000)

P-11: Latex of -Et(90)-MAA(10)-(molecular weight: 12000)

P-12: Latex of -St(70)-2EHA(27)-AA(3)-(molecular weight: 130000)

P-13: Latex of -MMA(63)-EA(35)-AA(2)-(molecular weight: 33000)

Abbreviations of the constituent monomers are as follows:

MMA: methyl methacrylate

EA: ethyl acrylate

MAA: methacrylic acid

2EHA: 2-ethylhexyl acrylate

St: styrene

Bu: butadiene

AA: acrylic acid

DVB: divinylbenzene

VC: vinyl chloride

AN: acrylonitrile

VDC: vinylidene chloride

Et: ethylene

IA: itaconic acid

The polymer latexes mentioned above are commercially available. Some commercial products employable herein are mentioned below. Examples of acrylic resins are CEBIAN A-4635, 46583, 4601 (all from Daicel Chemical Industries), Nipol Lx811, 814, 821, 820, 857 (all from Nippon Zeon), etc.; examples of polyester resins are FINETEX ES650, 611, 675, 850 (all from Dai-Nippon Ink & Chemicals), WD-size, WMS (both from Eastman Chemical), etc. examples of polyurethane resins are HYDRAN AP10, 20, 30, 40 (all from Dai-Nippon Ink & Chemicals). etc.; examples of rubber resins are LACSTAR 7310K, 3307B, 4700H, 7132C (all from Dai-Nippon Ink & Chemicals), Nipol Lx416, 410, 438C, 2507 (all from Nippon Zeon), etc.; examples of polyvinyl chloride resins are G351, G576 (both from Nippon Zeon), etc.; examples of polyvinylidene chloride resins are L502, L513 (both from Asahi Kasei), etc.; examples of polyolefin resins are CHEMIPEARL S120, SA100 (both from Mitsui Petrochemical), etc.

These polymer latexes may be used either singly or as combined in any desired manner.

For the polymer latex for use herein, especially preferred is styrene-butadiene copolymer latex. In the styrene-butadiene copolymer, the ratio of styrene monomer units to butadiene monomer units preferably falls between 40/60 and 95/5 by weight. Also preferably, the styrene monomer units and the butadiene monomer units account for from 60 to 99% by weight of the copolymer. The preferred range of the molecular weight of the copolymer is described in the above.

Preferred styrene-butadiene copolymer latexes for use in the invention are the above-mentioned P-3 to P-8, and commercial products, LACSTAR-3307B, 7132C, Nipol Lx416, etc.

The silver salt of an organic acid-containing layer of the photothermographic material of the invention may optionally contain a hydrophilic polymer such as gelatin, polyvinyl alcohol, methylcellulose, hydroxypropyl cellulose or the like. The amount of the hydrophilic polymer that may be in the layer is preferably at most 30% by weight, more preferably at most 20% by weight of all the binder in the silver salt of an organic acid-containing layer.

Preferably, a polymer latex is used for the binder in forming the silver salt of an organic acid-containing layer (that is, the image-forming layer) of the photothermographic material of the invention. Concretely, the amount of the binder in the silver salt of an organic acid-containing layer is such that the ratio by weight of total binder/silver salt of an organic acid falls between 1/10 and 10/1, more preferably between 1/5 and 4/1.

The silver salt of an organic acid-containing layer is generally a photosensitive layer (emulsion layer) containing a photosensitive silver salt, that is, a photosensitive silver halide. In the layer, the ratio by weight of total binder/silver halide preferably falls between 5 and 400, more preferably between 10 and 200.

The overall amount of the binder in the image-forming layer of the photothermographic material of the invention preferably falls between 0.2 and 30 g/m$^2$, more preferably between 1 and 15 g/m$^2$. The image-forming layer may optionally contain a crosslinking agent, a surfactant which is for improving the coatability of the coating solution for the layer, etc.

The solvent for the coating solution for the silver salt of an organic acid-containing layer of the photothermographic material of the invention (for simplifying the expression herein, the solvent shall indicate the category of solvents and dispersion media) is an aqueous solvent containing at least 30% by weight of water. For the aqueous solvent, water may be combined with any water-miscible organic solvent including, for example, methyl alcohol, ethyl alcohol, isopropyl alcohol, methyl cellosolve, ethyl cellosolve, dimethylformamide, ethyl acetate, etc. The water content of the solvent for the coating solution is preferably at least 50% by weight, more preferably at least 70% by weight. Preferred examples of the solvent composition are water, water/methyl alcohol=90/10 (% by weight—the same shall apply to the following), water/methyl alcohol=70/30, water/methyl alcohol/dimethylformamide=80/15/5, water/methyl alcohol/ethyl cellosolve=80/10/5, water/methyl alcohol/isopropyl alcohol=85/10/5, etc.

The photothermographic material of the invention may contain a sensitizing dye. Usable herein are sensitizing dyes which, after adsorbed onto silver halide grains, can spectrally sensitize the grains with in a desired wavelength range. Depending on the spectral characteristics of the light source to be used for exposure, favorable sensitizing dyes having good spectral sensitivity are selected for use in the photothermographic material of the invention. For the details of sensitizing dyes usable herein and methods for adding them to the photothermographic material of the invention, referred to are paragraphs 0103 to 0109 in JP-A 65021/1999; compounds of formula (II) in JP-A 186572/1998; from page 19, line 38 to page 20, line 35 in European Patent Laid-Open No. 0803764A1. Regarding the time at which the sensitizing dye is added to the silver halide emulsion, it is desirable that the sensitizing dye is added thereto after the desalting step but before the coating step, more preferably after the desalting step but before the chemical sensitization step.

Antifoggants, stabilizers and stabilizer precursors usable herein are described, for example, in JP-A 62899/1998, paragraph 0070, and in European Patent Laid-Open No. 0803764A1, from page 20, line 57 to page 21, line 7. Antifoggants preferred for use herein are organic halides. These are described, for example, in JP-A65012/1999, paragraphs 0111 to 0112. Especially preferred are compounds of formula (II) in JP-A 339934/1998, particularly, tribromomethylnaphthylsulfone, tribromomethylphenylsulfone, tribromomethyl(4-(2,4,6-trimethylsulfonyl)phenyl)sulfone, etc.

The antifoggant to be added to the emulsions for use herein is preferably in the form of a dispersion of fine solid grains. It may be formed into such a fine dispersion in any ordinary means (e.g., ball mill, shaking ball mill, sand mill, colloid mill, jet mill, roller mill, etc.). In forming the fine dispersion, if desired, anionic surfactant serving as a dispersant may be added thereto. One example of the anionic surfactant is a mixture of sodium triisopropylnaphthalenesulfonate isomers that differ from each other in the position of the three isopropyl groups therein.

Other examples of antifoggants usable herein are mercury (II) salts described in JP-A 65021/1999, paragraph 0113, and benzoic acid derivatives described in the same but in paragraph 0114.

The photothermographic material of the invention may also contain an azolium salt that serves as an antifoggant. The azolium salt includes, for example, compounds of formula (XI) described in JP-A 193447/1984, compounds described in JP-B 12581/1980, and compounds of formula (II) described in JP-A 153039/1985. The azolium salt may be present in any site of the photothermographic material, but is preferably in some layer on the side of the material on which is present a photosensitive layer. More preferably, it is added to the silver salt of an organic acid-containing layer of the material. Regarding the time at which the azolium salt is added to the material, it may be added to the coating solution at any stage of preparing the liquid. In case where it is to be present in the silver salt of an organic acid-containing layer, the azolium salt may be added to any of the reaction system to prepare the silver salt of an organic acid or the reaction system to prepare the coating solution at any stage of preparing them. Preferably, it is added to the coating solution after the stage of preparing the silver salt of an organic acid and just before the stage of coating the liquid. The azolium salt to be added may be in any form of powder, solution, fine grain dispersion, etc. It may be added along with other additives such as sensitizing dye, reducing agent, color tone adjustor, etc., for example, in the form of their solution. The amount of the azolium salt to be added to the photothermographic material of the invention is not specifically defined, but preferably falls between $1\times10^{-6}$ mols and 2 mols, more preferably between $1\times10^{-3}$ mols and 0.5 mols, per mol of silver in the material.

The photothermographic material of the invention may optionally contain mercapto compounds, disulfide compounds or thione compounds which are for retarding or promoting the developability of the material, or for enhancing the spectral sensitivity thereof, or for improving the storage stability thereof before and after development. For the additive compounds, for example, referred to are JP-A 62899/1998, paragraphs 0067 to 0069; compounds of formula (I) in JP-A 186572/1998, and their examples in paragraphs 0033 to 0052; European Patent Laid-Open No. 0803764A1, page 20, lines 36 to 56. Above all, preferred are mercapto-substituted heteroaromatic compounds.

A color tone adjustor is preferably added to the photothermographic material of the invention. Examples of the color tone adjustor usable herein are described in JP-A62899/1998, paragraphs 0054 to 0055, and European Patent Laid-Open No. 0803764A1, page 21, lines 23 to 48. Preferred for use herein are phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and their metal salts; combinations of phthalazinones and phthalic acid or its derivatives (e.g., phthalic acid, 4-methylphthalic acid, 4-nitrophthalic acid, tetrachlorophthalic anhydride, etc.); phthalazines (including phthalazine and phthalazine derivatives (e.g., 4-(1-naphthyl)phthalazine, 6-isopropylphthalazine, 6-t-butylphthalazine, 6-chlorophthalazine, 5,7-dimethoxyphthalazine, 2,3-dihydrophthalazine and other derivatives)) and their metal salts; combinations of phthalazines and phthalic acid or its derivatives (e.g., phthalic acid, 4-methylphthalic acid, 4-nitrophthalic acid, tetrachlorophthalic anhydride, etc.). More preferred are combinations of phthalazines and phthalic acid or its derivatives.

Plasticizers and lubricants that may be used in the photosensitive layer of the photothermographic material of the invention are described in JP-A 65021/1999, paragraph 0117; ultrahigh contrast agents for forming ultrahigh contrast images are described in the same but in paragraph 0118; and hardness promoters are described in the same but in paragraph 0102.

The photothermographic material of the invention may have a surface protective layer for preventing the image-forming layer from being blocked. The details of the surface protective layer are described, for example, in JP-A 65021/1999, paragraphs 0119 to 0120.

Gelatin is preferred for the binder in the surface protective layer, but polyvinyl alcohol (PVA) is also usable for it. PVA usable herein includes, for example, completely saponified PVA-105 [having a polyvinyl alcohol (PVA) content of at least 94.0% by weight, a degree of saponification of 98.5±0.5 mol %, a sodium acetate content of at most 1.5% by weight, a volatile content of at most 5.0% by weight, a viscosity (4% by weight at 20° C.) of 5.6±0.4 mPa·s]; partially saponified PVA-205 [having a PVA content of 94.0% by weight, a degree of saponification of 88.0±1.5 mol %, a sodium acetate content of 1.0% by weight, a volatile content of 5.0% by weight, a viscosity (4% by weight at 20° C.) of 5.0±0.4 mpa·s; modified polyvinyl alcohols, MP-102, MP-202, MP-203, R-1130, R2105 (all from Kraray), etc. The polyvinyl alcohol content (per $m^2$ of the support) of one protective layer preferably falls between 0.3 and 4.0 $g/m^2$, more preferably between 0.3 and 2.0 $g/m^2$.

The temperature at which the coating solution for the image-forming layer is prepared preferably falls between 30° C. and 65° C., more preferably between 35° C. and 60° C. but lower than 60° C., even more preferably between 35° C. and 55° C. Also preferably, the temperature of the coating solution is kept between 30° C. and 65° C. immediately after a polymer latex is added thereto. Still preferably, a reducing agent is mixed with a silver salt of an organic acid before a polymer latex is added to the salt to prepare the coating solution.

Preferably, the silver salt of an organic acid-containing liquid or the coating solution for the photothermographically image-forming layer is a thixotropic flow. Thixotropy indicates a phenomenon of a fluid of which the viscosity lowers with the increase in its shear rate. Any apparatus is usable for measuring the viscosity of the fluids for use herein, but preferred is Rheometrics Far East's RFS Fluid Spectrometer. The viscosity is measured at 25° C. Preferably, the silver salt of an organic acid-containing liquid or the coating solution for the photothermographically image-forming layer has a viscosity falling between 400 mPa·s and 100,000 mPa·s, more preferably between 500 mPa·s and 20,000 mPa·s, at a shear rate of 0.1 $sec^{-1}$. Also preferably, the viscosity falls between 1 mPa·s and 200 mPa·s, more preferably between 5 mPa·s and 80 mPa·s, at a shear rate of 1000 $sec^{-1}$.

Various thixotropic fluid systems are known, for example, described in Lecture on Rheology (Polymer Publishing); Polymer Latexes (by Muroi & Morino, Polymer Publishing), etc. Thixotropic fluids indispensably contain a large amount of fine solid grains. For enhancing their thixotropic capability, the fluids shall contain a viscosity-increasing linear polymer, or the fine solid grains therein shall be anisotropic and have an increased aspect ratio. Adding an alkaline viscosity-increasing agent or a surfactant to the fluids is also effective for that purpose.

One or more photothermographic emulsion layers are formed on one support to produce the photothermographic material of the invention. In case where the material has one emulsion layer, the layer must contain a silver salt of an organic acid, a silver halide, a developing agent and a binder, and optional additives of a color tone adjustor, a coating aid and other auxiliary agents. In case where the material has two emulsion layers, the first emulsion layer (in general, this is directly adjacent to the support) must contain a silver salt of an organic acid and a silver halide, and the second emulsion layer or the two layers must contain the other ingredients. Apart from these layer structures, also employable herein is another type of two-layered structure in which one layer is a single emulsion layer containing all the necessary ingredients and the other layer is a protective top coat layer. The photothermographic material for multi-color expression of the invention may have combinations of these two layers for the respective colors, or may contain all the necessary ingredients in a single layer, for example, as in U.S. Pat. No. 4,708,928. For the photothermographic material of a type containing a plurality of dyes for multi-color expression, the individual emulsion layers are differentiated and fractionated from the others via a functional or non-functional barrier layer between the adjacent emulsion layers, for example, as in U.S. Pat. No. 4,460,681.

The photosensitive layer of the photothermographic material of the invention may contain various types of dyes and pigments for improving the color tone, for preventing interference fringes during laser exposure, and for preventing irradiation. The details of such dyes and pigments are described in International Patent Publication No. WO98/36322. Preferred dyes and pigments for the photosensitive layer in the invention are anthraquinone dyes, azomethine dyes, indaniline dyes, azo dyes, anthraquinone-type indanthrone pigments (e.g., C. I. Pigment Blue 60, etc.), phthalocyanine pigments (e.g., copper phthalocyanines such as C.I. Pigment Blue 15, etc.; metal-free phthalocyanines such as C.I. Pigment Blue 16, etc.), triarylcarbonyl pigments of a type of printing lake pigments, indigo, inorganic pigments (e.g., ultramarine, cobalt blue, etc.). These dyes and pigments may be added to the layer in any desired manner. For example, prior to being added to the layer, they may be formed into solutions, emulsions or dispersions of fine solid grains, or may be mordanted with a polymer mordant. Depending on the intended degree of absorbance, the amount of the compound to be added to the layer varies, but may generally fall between 1 $\mu$g and 1 g per $m^2$ of the photothermographic material.

The photothermographic material of the invention may have an antihalation layer remoter from the light source to which it is exposed than its photosensitive layer. For the antihalation layer, referred to is JP-A 65021/1999, paragraphs 0123 to 0124.

Preferably, a decoloring dye and a base precursor are added to the non-photosensitive layer of the photothermographic material of the invention, in which the non-photosensitive layer containing the two could therefore function as a filter layer or an antihalation layer. Photothermographic materials generally have non-photosensitive layers in addition to photosensitive layers. Depending on their positions, the non-photosensitive layers are classified into (1) a protective layer to be disposed on a photosensitive layer (remoter from the support than the photosensitive layer); (2) an interlayer to be disposed between adjacent photosensitive layers or between a photosensitive layer and a protective layer; (3) a undercoat layer to be disposed between a photosensitive layer and a support; (4) a backing layer to be disposed on a support opposite to a photosensitive layer. The filter layers are provided as the layers (1) and (2), and the antihalation layers are provided as the layers (3) and (4).

In the photothermographic material of the invention, preferably, a decoloring dye and a base precursor are added to one and the same non-photosensitive layer. However, they may be added separately to adjacent two non-photosensitive layers. If desired, a barrier layer may be disposed between the two non-photosensitive layers.

For adding a decoloring dye to the non-photosensitive layer of the photothermographic material of the invention, for example, a solution or an emulsion of the dye, or a dispersion of fine grains of the dye, or a polymer with the dye infiltrated thereinto may be added to the coating solution for the non-photosensitive layer. The dye may also be added to the non-photosensitive layer along with a polymer mordant. These methods are the same as those generally employed for adding dyes to ordinary photothermographic materials. Polymer latexes into which decoloring dyes are infiltrated are described in U.S. Pat. No. 4,199,363, German Patent Laid-Open Nos. 25,141,274, 2,541,230, European Patent Laid-Open No. 029,104, and JP-A41091/1978. An emulsifying method of adding the dye to a polymer solution is described in International Patent Publication No. WO88/00723.

The amount of the decoloring dye to be added shall be determined, depending on the use of the dye. In general, its amount is so determined that the dye added could ensure an optical density (absorbance), measured at an intended wavelength, of larger than 1.0. The optical density preferably falls between 0.2 and 2. The amount of the dye capable of ensuring the optical density falling within the range may be generally from 0.001 to 1 $g/m^2$ or so, preferably from 0.005 to 0.8 $g/m^2$ or so, more preferably from 0.01 to 0.2 $g/m^2$ or so.

Decoloring the dyes in the photothermographic material in that manner can lower the optical density of the material to 0.1 or less. Two or more different types of decoloring dyes may be in thermodecoloring recording materials or photothermographic materials. Similarly, two or more different types of base precursors may be used in combination.

Preferably, the photothermographic material of the invention has, on one side of its support, at least one photosensitive layer containing a silver halide emulsion, and has a backing layer on the other side thereof. This is referred to as a single-sided photothermographic material.

Also preferably, the photothermographic material of the invention contains a matting agent which is for improving the transferability of the material. Matting agents are described in JP-A 65021/1999, paragraphs 0126 to 0127. The amount of the matting agent to be added to the photothermographic material of the invention preferably falls between 1 and 400 $mg/m^2$, more preferably between 5 and 300 $mg/m^2$ of the material.

The matting degree of the surface of the emulsion layer of the photothermographic material of the invention is not specifically defined, so far as the matted emulsion layer surface is free from star dust trouble, but is preferably such that the Beck's smoothness of the matted surface could fall between 50 seconds and 10000 seconds, more preferably between 80 seconds and 10000 seconds.

The matting degree of the backing layer of the photothermographic material of the invention preferably falls between 10 seconds and 1200 seconds, more preferably between 30 seconds and 700 seconds, even more preferably between 50 seconds and 500 seconds, in terms of the Beck's smoothness of the layer.

Preferably, the photothermographic material of the invention contains a matting agent in the outermost surface layer, or in a layer functioning as an outermost surface layer, or in a layer nearer to the outermost surface. Also preferably, it may contain a matting agent in a layer functioning as a protective layer.

The details of the backing layer applicable to the invention are described in JP-A 65021/1999, paragraphs 0128 to 0130.

A hardening agent may be added to the photosensitive layer, the protective layer, the backing layer and other layers of the photothermographic material of the invention. The details of the hardening agent applicable to the invention are described in T. H. James' The Theory of the Photographic Process, 4th Ed. (Macmillan Publishing Co., Inc., 1977), pp. 77–87. For example, preferred for use herein are polyvalent metal ions described on page 78 of the reference; polyisocyanates described in U.S. Pat. No. 4,281,060 and JP-A 208193/1994; epoxy compounds described in U.S. Pat. No. 4,791,042; vinylsulfone compounds described in JP-A 89048/1987, etc.

The hardening agent is added to coating solutions in the form of its solution. The time at which the solution is added to the coating solution for the protective layer may fall between 180 minutes before coating the liquid and a time just before the coating, preferably between 60 minutes before the coating and 10 seconds before it. However, there is no specific limitation thereon, so far as the method and the condition employed for adding the hardening agent to the coating solution ensure the advantages of the invention. As a method for addition, employable is a method of mixing a hardening agent with a coating solution in a tank in such a controlled manner that the mean residence time for the agent as calculated from the amount of the agent added and the flow rate of the coating solution to a coater could be a predetermined period of time; or a method of mixing them with a static mixer, for example, as in N. Harunby, M. F. Edwards & A. W. Nienow's Liquid Mixing Technology, Chap. 8 (translated by Koji Takahasi, published by Nikkan Kogyo Shinbun, 1989).

Surfactants which can be used in the photothermographic material of the invention are described in JP-A 65021/1999, paragraph 0132; solvents applicable thereto are in the same but in paragraph 0133; supports applicable thereto are in the same but in paragraph 0134; antistatic and electroconductive layers applicable thereto are in the same but in paragraph 0135; and methods of forming color images applicable thereto are in the same but in paragraph 0136.

Transparent supports for the photothermographic material of the invention may be colored with blue dyes (e.g., with dye-1 described in Examples of JP-A 240877/1996), or may be colorless. Technology for undercoating supports is described in JP-A 84574/1999, 186565/1998, etc. For antistatic layers and undercoat layers, referred to are the disclosures in JP-A 143430/1981, 143431/1981, 62646/1983, 120519/1981, etc.

Preferably, the photothermographic material of the invention is of a monosheet type. The monosheet type does not require any additional sheet to receive images thereon, but may directly form images on itself.

The photothermographic material of the invention may optionally contain an antioxidant, a stabilizer, a plasticizer, a UV absorbent or a coating agent (coating aid). Such additives may be in any of photosensitive layers or non-photosensitive layers of the material. For the additives, referred to are International Patent Publication No. WO98/36322, European Patent Laid-Open No. EP803764A1, JP-A 186567/1998, 18568/1998, etc.

To produce the photothermographic material of the invention, the coating solutions may be applied onto a support in any desired manner. Concretely, various types of coating techniques are employable herein, including, for example, extrusion coating, slide coating, curtain coating, dip coating, knife coating, flow coating, etc. Various types of hoppers for extrusion coating, which may be used in the present invention, are described in U.S. Pat. No. 2,681,294. Preferred for the photothermographic material of the invention is extrusion coating or slide coating described in Stephen F. Kistler & Petert M. Schweizer's Liquid Film Coating (Chapman & Hall, 1997), pp. 399–536. More preferred is slide coating. One example of the shape of a slide coater for slide coating is in FIG. 11b, 1, on page 427 of the reference. If desired, two or more layers may be formed at the same time, for example, according to the methods described from page 399 to page 536 of the reference, or to the methods described in U.S. Pat. No. 2,761,791 and British Patent 837,095.

Other techniques applicable to the photothermographic material of the invention are described in European patent Laid-Open Nos. EP803764A1, EP883022A1, International Patent Publication No. WO98/36322, JP-A 62648/1981, 62644/1983, 281637/1997, 297367/1997, 304869/1997, 311405/1997, 329865/1997, 10669/1998, 62899/1998, 69023/1998, 186568/1998, 90823/1998, 171063/1998, 186565/1998, 186567/1998, 186569/1998, 186570/1998, 186571/1998, 186572/1998, 197974/1998, 197982/1998, 197983/1998, 197985/1998, 197986/1998, 197987/1998, 207001/1998, 207004/1998, 221807/1998, 282601/1998, 288823/1998, 288824/1998, 307365/1998, 312038/1998, 339934/1998, 7100/1999, 15105/1999, 24200/1999, 24201/1999, 30832/1999, 84574/1999, 65021/1999.

The photothermographic material of the invention may be developed in any manner. In general, after having been imagewise exposed, it is developed under heat. Preferably, the temperature for the development falls between 80 and 250° C., more preferably between 100 and 140° C. The time for the development preferably falls between 1 and 180 seconds, more preferably between 10 and 90 seconds, even more preferably between 10 and 40 seconds.

For thermal development for the material, preferred is a plate heater system. For the plate heater system for the material of the invention, preferred are the methods described in Japanese Patent Application Nos. 229684/1997 and 177610/1998. The plate heater system described in these is for thermal development of photothermographic materials, in which a photothermographic material having been exposed to form a latent image thereon is brought into contact with a heating means in the zone for thermal development to thereby convert the latent image into a visible image. In this system, the heating means comprises a plate heater, and a plurality of presser rolls are disposed in series on one surface of the plate heater. The exposed photothermographic material is passed between the plurality of pressure rolls and the plate heater, whereby it is developed under heat. The plate heater is sectioned into 2 to 6 stages, and it is desirable that the temperature of the top stage is kept lower by 1 to 10° C. or so than that of the others. Such a system is also described in JP-A 30032/1979. In the plate heater system, water and organic solvent that remain in the photothermographic material being processed can be removed out of the material. In addition, the support of the photothermographic material rapidly heated is prevented from being deformed.

The photothermographic material of the invention can be exposed in any manner. For the light source to which the material is exposed, preferred are laser rays. Preferably, the laser rays are gas lasers ($Ar^+$, He—Ne), YAGlasers, color lasers, semiconductor lasers, etc. Also employable is a combination of semiconductor lasers and secondary harmonics generators. Preferred for the material of the invention are gas or semiconductor lasers for red to infrared emission.

For the laser rays applicable to the photothermographic material of the invention, usable are single mode lasers. For these, for example, referred to is the technique disclosed in JP-A 65021/1999, paragraph 0140.

Preferably, the laser output is at least 1 mW, more preferably at least 10 mW. Even more preferred is high output of at least 40 mW. If desired, a plurality of lasers may be combined for use herein. The diameter of one laser ray may be on the level of $1/e^2$ spot size of a Gaussian beam, falling between 30 and 200 $\mu$m or so.

A laser imager equipped with an exposure zone and a thermal development zone, Fuji Medical Dry Laser Imager FM-DPL is usable for processing the photothermographic material of the invention.

The photothermographic material of the invention forms a monochromatic image based on silver, and is favorable for use in medical diagnosis, industrial photography, printing, and COM. In such applications, needless-to-say, the monochromatic images formed can be duplicated on Fuji Photo Film's duplicating films, MI-Dup for medical diagnosis; and for prints, the images can be used as the mask for forming reverse images on printing films such as Fuji Photo Film's DO-175 and PDO-100, or on offset printing plates.

EXAMPLES

The invention is described in more detail with reference to the following Examples, which, however, are not intended to restrict the scope of the invention.

Example 1

<Preparation of PET Support>

From terephthalic acid and ethylene glycol, formed was PET in an ordinary manner. PET thus formed had an intrinsic viscosity, IV of 0.66, measured in phenol/tetrachloroethane (6/4 by weight) at 25° C. This was pelletized, then dried at 130° C. for 4 hours, and melted at 300° C. The PET melt was extruded out through a T-die, and rapidly cooled to be a non-oriented film, of which the thickness was so controlled that its thickness could be 175 $\mu$m after thermal fixation.

The film was stretched 3.3 times in MD (machine direction), for which were used rolls rotating at different speeds. Next, this was stretched 4.5 times in CD (cross direction) in a tenter. The temperature for MD and CD stretching was 110° C. and 130° C., respectively. Next, this was thermally fixed at 240° C. for 20 seconds, and then relaxed by 4% in CD at the same temperature. Next, the chuck of the tenter was released, the both edges of the film was knurled, and the film was rolled up under 4 kg/cm$^2$. The rolled film had a thickness of 175 $\mu$m.

<Surface Corona Discharge Treatment>

Both surfaces of the support were subjected to corona discharge treatment at room temperature at a speed of 20 m/min, for which was used a Pillar's solid-state corona discharge processor, Model 6KVA. From the data of the current and the voltage read on the device, it was seen that the support was processed at 0.375 kV.A.min/m$^2$. The frequency for the treatment was 9.6 kHz, and the gap clearance between the electrode and the dielectric roll was 1.6 mm.

<Preparation of Undercoated Support>

(1) Preparation of Coating Solution for Undercoating Layer:

Formulation (1) (for undercoat layer on the side of photosensitive layer):

- Takamatsu Yushi's Pesuresin A-515GB, 30% by weight solution 234 g
- Polyethylene glycol monononylphenyl ether (mean number of ethylene oxides=8.5), 10% by weight solution 21.5 g Soken Chemical's MP-1000 (fine polymer grains, mean grain size 0.4 μm) 0.91 g Distilled water 744 ml Formulation (2) (for first undercoat layer to be on back surface):

Butadiene-styrene copolymer latex (solid content 40% by weight, butadiene/styrene=32/68 by weight) 158 g 2,4-Dichloro-6-hydroxy-S-triazine sodium salt, 8% by weight aqueous solution 20 g Sodium laurylbenzenesulfonate, 1% by weight aqueous solution 10 ml Distilled water 854 ml Formulation (3) (for second undercoat layer on the back side):

$SnO_2$/SbO (9/1 by weight, mean grain size 0.038 μm), 17% by weight dispersion 84 g Gelatin, 10% aqueous solution 89.2 g Shin-etsu Chemical's Metolose TC-5, 2% aqueous solution 8.6 g Soken Chemical's MP-1000 (fine polymer grains) 0.01 g Sodium dodecylbenzenesulfonate, 1% by weight aqueous solution 10 ml NaOH (1%) 6 ml Proxel (from ICI) 1 ml Distilled water 805 ml <Process of Undercoating Support>

Both surfaces of the bi-oriented polyethylene terephthalate support (thickness: 175 μm) were subjected to corona discharge treatment in the manner as mentioned above. One surface (on the side of a photosensitive layer) of the support was coated with the coating solution of undercoat layer formulation (1) by the use of a wire bar, and then dried at 180° C. for 5 minutes. The wet weight of the coated liquid was 6.6 ml/$m^2$ (per surface). Next, the other surface (back surface) of the support was coated with the coating solution of undercoat layer formulation (2) by the use of a wire bar, and then dried at 180° C. for 5 minutes. The wet weight of the coated liquid was 5.7 ml/$m^2$. The thus-coated back surface was further coated with the coating solution of undercoat layer formulation (3) by the use of a wire bar, and then dried at 180° C. for 6 minutes. The wet weight of the coated liquid was 7.7 ml/$m^2$. In that manner, the undercoated support was prepared.

<Preparation of Coating Solution for Back Surface>

Preparation of Dispersion (a) of Fine Solid Grains of Base Precursor:

64 g of a base precursor compound 11, 28 g of diphenylsulfone and 10 g of Kao's surfactant Demole N were mixed in 220 ml of distilled water, and the resulting mixture was milled in a sand mill (¼ Gallon Sand Grinder Mill from Imex) with beads. In the thus-prepared dispersion (a), fine solid grains of the base precursor compound had a mean grain size of 0.2 μm.

Preparation of Dispersion of Fine Solid Grains of Dye:

9.6 g of a cyanine dye compound 13 and 5.8 g of sodium p-dodecylbenzenesulfonate were mixed in 305 ml of distilled water, and the resulting mixture was milled in a sand mill (¼ Gallon Sand Grinder Mill from Imex) with beads. In the thus-prepared dye dispersion, fine solid grains of the dye had a mean grain size of 0.2 μm.

<Preparation of Coating Solution for Antihalation Layer>

17 g of gelatin, 9.6 g of polyacrylamide, 70 g of the base precursor dispersion (a), 56 g of the dye dispersion, 1.5 g of fine grains of polymethyl methacrylate (mean grain size: 6.5 μm), 0.03 g of benzoisothiazolinone, 2.2 g of sodium polyethylenesulfonate, 0.2 g of a blue dye compound 14, and 844 ml of water were mixed to prepare a coating solution for an antihalation layer.

<Preparation of Coating Solution for Back Surface Protective Layer>

A reactor was kept heated at 40° C. In this, 50 g of gelatin, 0.2 g of sodium polystyrenesulfonate, 2.4 g of N,N-ethylenebis(vinylsulfonacetamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether (mean degree of polymerization of ethylene oxides, 15), 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio, 5/95 by weight), 0.6 g of Aerosol OT (from American Cyanamide), 1.8 g (in terms of liquid paraffin) of liquid paraffin emulsion, and 950 ml of water were mixed to prepare a coating solution for a back surface protective layer.

<Preparation of Fine Grains of Silver Halide>

To 1420 ml of distilled water, added were 3.1 ml of aqueous 1% by weight potassium bromide solution, 3.5 ml of aqueous 0.5 mol/L sulfuric acid solution and 31.7 g of phthaloylgelatin. The resulting solution was kept stirred at 39° C. in a stainless reactor, to which were added 97.4 ml of aqueous 1.37 mol/L potassium bromide solution (a) and 95.4 ml of aqueous 1.37 mol/L silver nitrate solution (b) by double jets over a period of 45 seconds. Next, 10 ml of aqueous 3.5% by weight hydrogen peroxide and then 10.8 ml of aqueous 10% by weight solution of compound 1 were added thereto. Next, 317.5 ml of aqueous 0.96 mol/L silver nitrate solution (c) was added thereto along with aqueous 0.96 mol/L potassium bromide solution (d) by controlled double jets over a period of 30 minutes, with pAg of the system being kept at 7.7. While they were added, an aqueous solution of tripotassium hexachloroiridate was added thereto all at the same time. Its amount added was finally $1\times10^{-4}$ mols per mol of silver. Next, 25 ml of aqueous 1% by weight potassium bromide solution and 33 ml of aqueous 0.5 mol/L sulfuric acid solution were added thereto, and the system was controlled to have pH of 3.8. Then, stirring was stopped. The reactionmixturewas precipitated, desalted and washed with water. $2.6\times10^{-4}$ mols, per mol of silver, of compound 2 was added thereto, and aqueous solution of 1 mol/L sodium hydroxide and 1% by weight potassium bromide was added thereto. The system was thus controlled to have pH of 5.9 and pAg of 8.2 at 37° C. The emulsion thus obtained is a silver halide dispersion.

With stirring the emulsion at 37° C., $5\times10^{-3}$ mols, per mol of silver, of spectral sensitizing dye A was added thereto. After 1 minute, the mixture was heated up to 47° C.; after 18 minutes, $3\times10^{-5}$ mols, per mol of silver, of compound 3 was added thereto; and still after 5 minutes, $5\times10^{-5}$ mols, per mol of silver, of tellurium sensitizer B was added thereto. Then, this was ripened for 80 minutes. Just before ripening was finished, $1\times10^{-4}$ mols, per mol of silver, of compound 4 was added to this, and the temperature was lowered to 30° C. Then, 22.2 ml of 3% by weight solution of compound 5 in methanol was added thereto. In that manner, the emulsion was chemically sensitized. This is referred to as emulsion 1. The grains in the thus-prepared silver halide emulsion 1 were pure silver bromide grains having a mean sphere-corresponding diameter of 0.057 μm and having a sphere-corresponding diameter fluctuation coefficient of 22%. To obtain the mean grain size, 500 grains were measured with an electronic microscope, and their data were averaged.

Other emulsions given in Table 1 below were prepared in the same manner as in the process of preparing emulsion 1. For the other emulsions, however, additive A as in Table 1 was added to the reaction system, 5 seconds after the aqueous silver nitrate solution (c) and the aqueous potassium bromide solution (d) were completely added thereto, and additive B in a mixture of compound 5 and methanol was added thereto; and the amount of the chemical sensitizer and that of the sensitizing dye were so controlled as to be able to ensure the optimum sensitivity in sensitometry to be mentioned hereinunder.

-continued

Compound 5

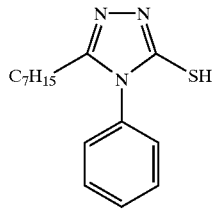

Compound 6

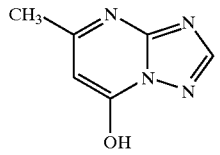

TABLE 1

| Emulsion No. | Additive A (amount added: mol/mol Ag) | Additive B (amount added: mol/mol Ag) | Grain Size μm | Fluctuation Coefficient | |
|---|---|---|---|---|---|
| 1 | — | — | 0.058 | 23% | comparative sample |
| 2 | — | I-2 ($3.8 \times 10^{-4}$) | 0.057 | 23% | comparative sample |
| 3 | — | I-2 ($7.6 \times 10^{-4}$) | 0.057 | 22% | comparative sample |
| 4 | — | I-2 ($1.5 \times 10^{-3}$) | 0.057 | 24% | comparative sample |
| 5 | — | I-5 ($3.8 \times 10^{-4}$) | 0.057 | 22% | comparative sample |
| 6 | — | I-5 ($7.6 \times 10^{-4}$) | 0.058 | 24% | comparative sampie |
| 7 | — | I-5 ($1.5 \times 10^{-3}$) | 0.058 | 23% | comparative sample |
| 8 | $K_4[Fe(CN)_6]$ ($1 \times 10^{-4}$) | — | 0.056 | 22% | comparative sample |
| 9 | $K_4[Fe(CN)_6]$ ($3 \times 10^{-4}$) | — | 0.054 | 23% | comparative sample |
| 10 | $K_4[Fe(CN)_6]$ ($1 \times 10^{-3}$) | — | 0.053 | 21% | comparative sample |
| 11 | $K_4[Fe(CN)_6]$ ($1 \times 10^{-4}$) | I-2 ($7.6 \times 10^{-4}$) | 0.055 | 23% | sample of the invention |
| 12 | $K_4[Fe(CN)_6]$ ($3 \times 10^{-4}$) | I-2 ($7.6 \times 10^{-4}$) | 0.054 | 23% | sample of the invention |
| 13 | $K_4[Fe(CN)_6]$ ($1 \times 10^{-3}$) | I-2 ($7.6 \times 10^{-4}$) | 0.052 | 20% | sample of the invention |
| 14 | $K_4[Fe(CN)_6]$ ($1 \times 10^{-4}$) | I-5 ($7.6 \times 10^{-4}$) | 0.055 | 24% | sample of the invention |
| i5 | $K_4[Fe(CN)_6]$ ($3 \times 10^{-4}$) | I-5 ($7.6 \times 10^{-4}$) | 0.053 | 26% | sample of the invention |
| 16 | $K_4[Fe(CN)_6]$ ($1 \times 10^{-3}$) | I-5 ($7.6 \times 10^{-4}$) | 0.053 | 23% | sample of the invention |
| 17 | $K_4[Ru(CN)_6]$ ($3 \times 10^{-4}$) | I-2 ($7.6 \times 10^{-4}$) | 0.054 | 22% | sample of the invention |
| 18 | $K_4[Ru(CN)_6]$ ($3 \times 10^{-3}$) | I-5 ($7.6 \times 10^{-4}$) | 0.053 | 21% | sample of the invention |
| 19 | Compound 6($1 \times 10^{-4}$) | | 0.058 | 23% | comparative sample |
| 20 | Compound 6($1 \times 10^{-3}$) | | 0.056 | 22% | comparative sample |
| 21 | Compound 6($1 \times 10^{-4}$) | I-2 ($7.6 \times 10^{-4}$) | 0.057 | 23% | comparative sample |
| 22 | Compound 6($1 \times 10^{-3}$) | I-2 ($7.6 \times 10^{-4}$) | 0.057 | 21% | comparative sample |

Compound 1

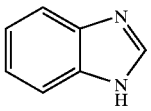

Compound 2

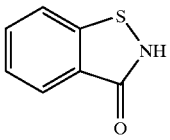

Compound 3

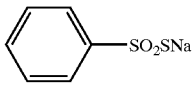

Compound 4

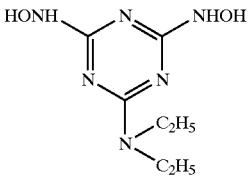

<Preparation of Scaly Silver Salt of Fatty Acid>

87.6 kg of benenic acid (Henkel's Edenor C22-85R), 423 L of distilled water, 49.2 L of aqueous 5 mol/L NaOH solution, and 120 L of tert-butanol were mixed and reacted with stirring at 75° C. for 1 hour to prepare a solution of sodium behenate. Apart from this, 206.2 L of an aqueous solution (pH 4.0) of 40.4 kg of silver nitrate was prepared, and kept at 10° C. 635 L of distilled water and 30 L of tert-butanol were put into a reactor, and kept at 30° C. With stirring it, all the sodium behenate solution prepared previously and all the aqueous silver nitrate solution also prepared previously were fed into the reactor both at a predetermined flow rate, which took 62 minutes and 10 seconds, and 60 minutes, respectively. Feeding them into the reactor was so controlled that, for 7 minutes and 20 seconds after the start of feeding the aqueous silver nitrate solution, only the aqueous silver nitrate solution is fed into the reactor, then feeding the sodium behenate solution was started, and for 9 minutes and 30 seconds after feeding the aqueous silver nitrate was finished, only the sodium benenate solution was fed into the reactor. In this stage, the temperature inside the reactor was 30° C., and the temperature outside it was so controlled that the temperature of the reaction system in the reactor could be kept constant. The pipe line for the sodium behenate solution was thermally insulated through steam tracing, and the steam opening was so controlled that the temperature of the liquid at the outlet of the nozzle tip could be 75° C. The pipe line for the aqueous silver nitrate solution was thermally insulated by circulating cold water through the interspace of the double-walled pipe. Regarding the position at which the sodium behenate solution is added to the reaction system and that at which the aqueous silver nitrate solution is added thereto, the two were disposed symmetrically to each other relative to the shaft of the stirrer disposed in the reactor, and the nozzle tips for the two solutions were spaced from the reaction liquid in the reactor.

After adding the sodium behenate solution was finished, the reaction system was kept stirred for 20 minutes at the determined temperature, and then cooled to 25° C. After this, the solids formed in the system were taken out through suction filtration, and then washed with water until the conductivity of the wash waste reached 30 μS/cm. The solids thus obtained are of a silver salt of the fatty acid. These were stored as wet cake without drying.

The silver behenate grains obtained herein were analyzed for morphology on their images taken through electronmicroscopic photography. Their data were as follows: a=0.14 μm, b=0.4 μm and c=0.6 μm all on average (a, b and c are defined hereinabove). The mean aspect ratio was 5.2. The mean sphere-corresponding diameter was 0.52 μm. The mean sphere-corresponding fluctuation coefficient was 15%. The grains were identified as scaly crystals by these data.

To the wet cake corresponding to 100 g of its dry weight, added was 7.4 g of polyvinyl alcohol (PVA-217) along with water to make 385 g in total. The resulting mixture was pre-dispersed in a homo-mixer.

Next, the pre-dispersed stock was processed three times in a dispersion mixer (Microfluidizer M-110S-EH from Microfluidex International Corporation, equipped with an interaction chamber, G10Z) under a controlled pressure of 1750 kg/cm$^2$. To cool the system being processed, bellows-type heat exchangers were disposed before and after the interaction chamber. The temperature of the coolant in these heat exchangers was so controlled that the system could be processed at a constant temperature of 18° C. Thus was obtained a silver behenate dispersion.

<Preparation of 25% by Weight Dispersion of Reducing Agent>

16 kg of water was added to 10 kg of 1,1-bis(2-hydroxy-3,5-dimethylphenyl)-3,5,5-trimethylhexane and 10 kg of aqueous 20% by weight solution of modified polyvinyl alcohol (Kuraray's Poval MP203), and well mixed to give a slurry. Via a diaphragm pump, the slurry was fed into a horizontal sand mill (Imex's UVM-2) filled with zirconia beads having a mean diameter of 0.5 mm, and dispersed therein for 3 hours and 30 minutes. Then, 0.2 g of benzoisothiazolinone sodium salt was added thereto along with water to prepare a reducing agent dispersion having a reducing agent concentration of 25% by weight. The reducing agent grains in the dispersion had a median diameter of 0.42 μm, and a maximum grain size of at most 2.0 μm. The dispersion was filtered through a polypropylene filter having a pore size of 10.0 μm to remove impurities from it, and then stored.

<Preparation of 10% by Weight Dispersion of Mercapto Compound>

8.3 kg of water was added to 5 kg of 1-phenyl-2-heptyl-5-mercapto-1,3,4-triazole and 5 kg of aqueous 20% by weight solution of modified polyvinyl alcohol (Kuraray's Poval MP203), and well mixed to give a slurry. Via a diaphragm pump, the slurry was fed into a horizontal sand mill (Imex's UVM-2) filled with zirconia beads having a mean diameter of 0.5 mm, and dispersed therein for 6 hours. Then, water was added thereto to prepare a mercapto compound dispersion having a concentration of 10% by weight. The mercapto compound grains in the dispersion had a median diameter of 0.40 μm, and a maximum grain size of at most 2.0 μm. The dispersion was filtered through a polypropylene filter having a pore size of 10.0 μm to remove impurities from it, and then stored. Just before use, it was again filtered through a polypropylene filter having a pore size of 10 μm.

<Preparation of 20% by Weight Organic Polyhalogen Compound Dispersion 1>

5 kg of tribromomethylnaphthylsulfone, 2.5 kg of aqueous 20% by weight solution of modified polyvinyl alcohol (Kuraray's Poval MP203), 213 g of aqueous 20% by weight solution of sodium triisopropylnaphthalenesulfonate, and 10 kg of water were well mixed to prepare a slurry. Via a diaphragm pump, the slurry was fed into a horizontal sand mill (Imex's UVM-2) filled with zirconia beads having a mean diameter of 0.5 mm, and dispersed therein for 5 hours. Then, 0.2 g of benzoisothiazolinone sodium salt was added thereto along with water to prepare a 20% by weight dispersion of the organic polyhalogen compound. The organic polyhalogen compound grains in the dispersion had a median diameter of 0.36 μm, and a maximum grain size of at most 2.0 μm. The dispersion was filtered through a polypropylene filter having a pore size of 3.0 μm to remove impurities from it, and then stored.

<Preparation of 25% by Weight Organic Polyhalogen Compound Dispersion 2>

In the same manner as in the above of preparing the 20% by weight organic polyhalogen compound dispersion 1, a 25% by weight organic polyhalogen compound dispersion 2 was prepared. In this, however, 5 kg of tribromomethyl(4-(2,4,6-trimethylphenylsulfonyl)phenyl)sulfone was used instead of tribromomethylnaphthylsulfone, and the process of dispersing it and diluting and filtering the product was the same as that for the dispersion 1. The organic polyhalogen compound grains was prepared in 25% by weight dispersion, which had a median diameter of 0.38 μm, and a maximum grain size of at most 2.0 μm. The dispersion was filtered through a polypropylene filter having a pore size of 3.0 μm to remove impurities from it, and then stored.

<Preparation of 30% by Weight Organic Polyhalogen Compound Dispersion 3>

In the same manner as in the above of preparing the 20% by weight organic polyhalogen compound dispersion 1, a 30% by weight organic polyhalogen compound dispersion 3 was prepared. In this, however, 5 kg of tribromomethylphenylsulfone was used instead of tribromomethylnaphthylsulfone, and 5 kg of aqueous 20% by weight MP203 solution was used. The process of dispersing the system and diluting and filtering the product was the same as that for the dispersion 1. The organic polyhalogen compound grains was prepared in 30% by weight dispersion, which had a median diameter of 0.41 μm, and a maximum grain size of at most 2.0 μm. The dispersion was filtered through a polypropylene filter having a pore size of 3.0 μm to remove impurities from it, and then stored. Before use, it was kept stored at 10° C. or lower.

<Preparation of 5% by Weight Solution of Phthalazine Compound>

8 kg of Kuraray's modified polyvinyl alcohol MP203 was dissolved in 174.57 kg of water, to which were added 3.15 kg of aqueous 20% by weight solution of sodium triisopropylnaphthalenesulfonate and 14.28 kg of aqueous 70% by weight solution of 6-isopropylphthalazine to prepare aqueous 5% by weight solution of 6-isopropylphthalazine.

<Preparation of 20% by Weight Pigment Dispersion>

250 g of water was added to 6.4 g of C.I. Pigment Blue 60 and 6.4 g of Kao's Demole N, and well mixed to give a slurry. 800 g of zirconia beads having a mean diameter of 0.5 mm were prepared and put into a vessel along with the slurry. The slurry thus in the vessel was milled by the use of a dispersion mill (Imex's 1/4G Sand Grinder Mill) for 25 hours to obtain a pigment dispersion. The pigment grains in the dispersion had a mean grain size of 0.21 $\mu$m.

<Preparation of 40% by Weight SBR Latex>

SBR latex purified through ultrafiltration (UF) was prepared as follows:

SBR latex mentioned below was diluted 10-fold with distilled water, and the resulting latex dilution was purified through a UF purification module, FS03-FC-FUY03A1 (from Daisen Membrane System) until it has an ion conductivity of 1.5 mS/cm. To this was added Sanyo Kasei's Sandet-BL of which the concentration in the resulting latex dilution was 0.22% by weight. Next, NaOH and $NH_4OH$ were added to it so that the ion ratio of $Na^+/NH4^+$ in the latex dilution could be 1/2.3 by mol. The latex dilution was thus controlled to have pH of 8.4. Its latex concentration was 40% by weight.

SBR latex used herein is -St(68)-Bu(29)-AA(3)-latex, in which St is styrene, Bu is butadiene and AA is acrylic acid.

Its mean grain size was 0.1 $\mu$m, concentration was 45%, equilibrium water content at 25° C. and relative humidity of 60% was 0.6% by weight, ion conductivity was 4.2 mS/cm, and pH was 8.2. To measure the ion conductivity, used was a Toa Denpa Kogyo's conductometer CM-30S. In the device, the 40% latex was measured at 25° C.

<Preparation of Coating Solution for Emulsion Layer (Photosensitive Layer)>

1.1 g of the aqueous 20% by weight pigment dispersion, 103 g of the dispersion of silver salt of an organic acid, 5 g of aqueous 20% by weight solution of polyvinyl alcohol PVA-205 (from Kuraray), 25 g of the 25% by weight reducing agent dispersion, 16.3 g in total of the organic polyhalogen compound dispersions 1, 2 and 3 in a ratio of 5/1/3 by weight, 6.2 g of the 10% by weight mercapto compound dispersion, 106 g of the 40% by weight, UF-purified, pH-controlled SBR latex, and 18 ml of the 5% by weight phthalazine compound solution, all prepared hereinabove, were mixed, to which was added 10 g of the silver halide emulsion indicated in Table 1 above, and well mixed to prepare a coating solution for an emulsion layer. This is directly fed into a coating die, with its flow rate being so controlled that its amount coated can be 70 ml/m$^2$.

The viscosity of the coating solution was measured with a Tokyo Keiki's B-type viscometer, and was 85 mPa·s at 40° C. when stirred with the No. 1 rotor at 60 rpm.

On the other hand, when measured with Rheometrics Far East's RFS Fluid Spectrometer at 25° C., the viscosity of the coating solution was 1500, 220, 70, 40 and 20 mPa·s at a shear rate of 0.1, 1, 10, 100 and 1000 sec$^{-1}$, respectively.

<Preparation of Coating Solution for Interlayer on the Side of Emulsion Layer>

To 772 g of aqueous 10% by weight solution of polyvinyl alcohol PVA-205 (from Kuraray), 5.3 g of the 20% by weight pigment dispersion, and 226 g of 27.5% by weight latex of methyl methacrylate/styrene/butyl acrylate/hydroxyethyl methacrylate/acrylic acid copolymer (copolymerization ratio 64/9/20/5/2 by weight), added were 2 ml of aqueous 5% by weight solution of Aerosol OT (from American Cyanamide), 10.5 ml of aqueous 20% by weight solution of diammonium phthalate, and water to make 880 g in total. The resulting mixture is a coating solution for an interlayer. This is fed into a coating die, with its flow rate being so controlled that its amount coated can be 10 ml/m$^2$.

The viscosity of the coating solution, measured with a B-type viscometer (with No. 1 rotor at 60 rpm), was 21 mPa·s at 40° C.

<Preparation of Coating Solution for First Emulsion-protective Layer>

64 g of inert gelatin was dissolved in water, to which were added 80 g of 27.5% by weight latex of methyl methacrylate/styrene/butyl acrylate/hydroxyethyl methacrylate/acrylic acid copolymer (copolymerization ratio 64/9/20/5/2 by weight), 23 ml of 10% by weight solution of phthalic acid in methanol, 23 ml of aqueous 10% by weight solution of 4-methylphthalic acid, 28 ml of 0.5 mol/L sulfuric acid, 5 ml of aqueous 5% by weight solution of Aerosol OT (from American Cyanamide),0.5 g of phenoxyethanol, 0.1 g of benzoisothiazolinone, and water to make 750 g in total. Just before use, 26 ml of 4% by weight chromium alum is added to the mixture, and stirred with a static mixer. This is a coating solution for a first emulsion-protective layer. The coating solution is fed into a coating die, with its flow rate being so controlled that its amount coated can be 18.6 ml/m$^2$.

The viscosity of the coating solution, measured with a B-type viscometer (with No. 1 rotor at 60 rpm), was 17 mPa·s at 40° C.

<Preparation of Coating Solution for Second Emulsion-protective Layer>

80 g of inert gelatin was dissolved in water, to which were added 102 g of 27.5% by weight latex of methyl methacrylate/styrene/butyl acrylate/hydroxyethyl methacrylate/acrylic acid copolymer (copolymerization ratio 64/9/20/5/2 by weight), 3.2 ml of 5% by weight solution of N-perfluorooctylsulfonyl-N-propylalanine potassium salt, 32 ml of aqueous 2% by weight solution of polyethylene glycol mono(N-perfluorooctylsulfonyl-N-propyl-2-aminoethyl) ether (mean degree of polymerization of ethylene oxides=15), 23 ml of 5% by weight solution of Aerosol OT (from American Cyanamide), 4 g of fine polymethyl methacrylate grains (mean grain size 0.7 $\mu$m), 21 g of fine polymethyl methacrylate grains (mean grain size of 6.4 $\mu$m), 1.6 g of 4-methylphthalic acid, 4.8 g of phthalic acid, 44 ml of 0.5 mol/L sulfuric acid, 10 mg of benzoisothiazolinone, and water to make 650 g in total. Just before use, 445 ml of aqueous solution of 4% by weight chromium alum with 0.67% by weight phthalic acid is added to the mixture, and stirred with a static mixer. This is a coating solution for a second emulsion-protective layer. The coating solution is fed into a coating die, with its flow rate being so controlled that its amount coated can be 8.3 ml/m$^2$.

The viscosity of the coating solution, measured with a B-type viscometer (with No. 1 rotor at 60 rpm), was 9 mPa·s at 40° C.

<Preparation of Photothermographic Material>

Onto the back surface of the undercoated support, simultaneously applied were the coating solution for an antihalation layer (its amount was so controlled that the amount of the solid fine grains coated could be 0.04 g/m$^2$) and the coating solution for a back-protective layer (its amount was so controlled that the amount of gelatin coated could be 1.7 g/m$^2$) to form the two layers thereon, and dried. Thus, the back surface of the support was coated with a two-layered, antihalation backing layer.

Onto the other surface opposite to the back surface of the support, simultaneously applied were the coating solutions for an emulsion layer (the amount of the silver halide coated being 0.14 g/m$^2$ in terms of silver), an interlayer, a first protective layer and a second protective layer in that order, according to a slide bead coating system. Thus were prepared samples of photothermographic materials.

The coating speed was 160 m/min. The distance between the coating die tip and the support fell between 0.14 and 0.28 mm. The jet nozzle was so controlled that the coating solution being jetted out therethrough could spread 0.5 mm on both sides relative to the nozzle orifice, and the pressure in the degassing chamber was kept lower by 392 Pa than the atmospheric pressure. While being coated, the support was carefully handled so as not to be electrically charged with the temperature and humidity around it being well conditioned. Specifically, before being coated, the support was destaticized with an ion blow being applied thereto. In the subsequent chilling zone, the coated support was chilled with an air blow (its dry-bulb temperature was 18° C. and wet-bulb temperature was 12° C.) being applied thereto for 30 seconds. In the next helical lifting-up drying zone, this was dried with a dry air blow (its dry-bulb temperature was 30° C. and wet-bulb temperature was 18° C.) being applied thereto for 200 seconds. Then, this was passed through the next drying zone at 70° C. through which it took 20 seconds, and thereafter through still the next drying zone at 90° C. through which it took 10 seconds. Finally, this was cooled to 25° C. In that manner, the solvent in the coated liquid was vaporized away. In the chilling zone and the drying zone, the mean wind velocity of the air blow applied to the coated surface was 7 m/sec.

Spectral Sensitizing Dye A:

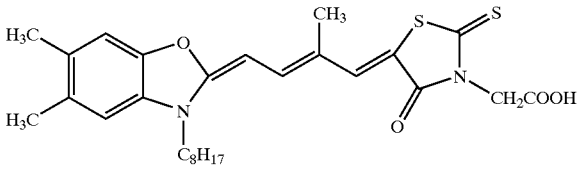

Tellurium Sensitizer B:

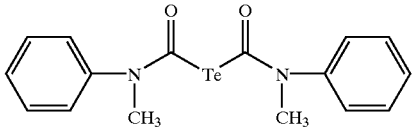

Base Precursor Compound 11:

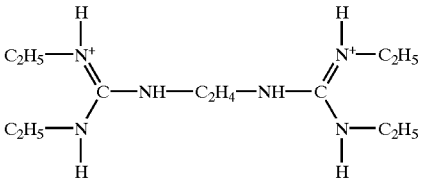

-continued

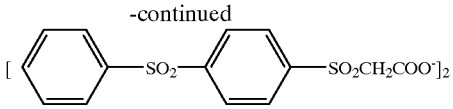

Canine Dye Compound 13:

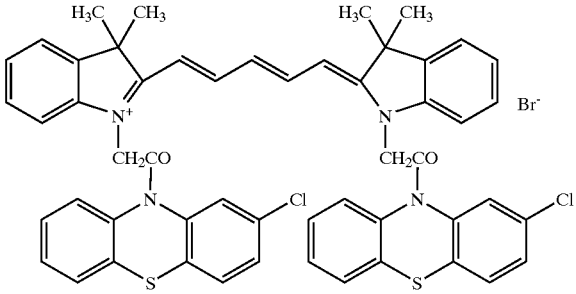

Blue Dye Compound 14:

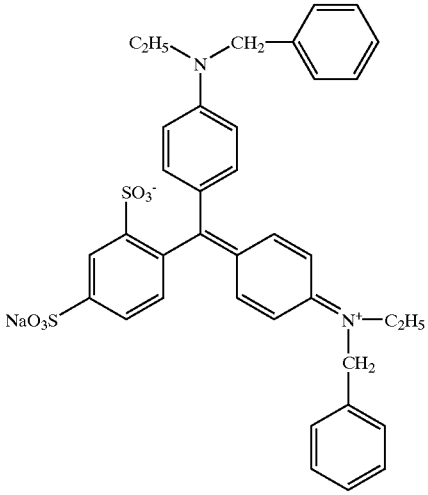

<Evaluation of Photographic Performances>

Using Fuji Medical Dry Laser Imager FM-DPL (equipped with a 660 nm semiconductor laser capable of producing a maximum output of 60 mW (IIIB)), the samples of photothermographic materials prepared hereinabove were exposed, and thermally developed at about 120° C. Using a densitometer, the images formed were analyzed for fog (Dmin) and Dmax. The sensitivity of the samples was obtained from the reciprocal of the ratio of the exposure amount that gave a density higher by 1.0 than the fog. The sensitivity of sample No. 1 is standardized to be 100, and the sensitivity of the other samples is expressed as a relative value based on the standard sensitivity (100) of sample No. 1. The data obtained are given in Table 2 below.

<Evaluation of Storage Stability Before Image Formation>

The coated samples were stored in a high-temperature high-humidity atmosphere (60° C., relative humidity of 60%) for 7 hours, and their photographic performances were evaluated in the same manner as above. This indicates the storage stability of the samples before processed for image formation. The data obtained are given in Table 2.

TABLE 2

| Sample | Photographic Properties | | | Storage Stability before Image Formation | | | |
|---|---|---|---|---|---|---|---|
| No. | Fog | Sensitivity | Dmax | Fog | Sensitivity | Dmax | |
| 1 | 0.21 | 100 | 3.60 | 0.32 | 60 | 3.54 | comparative samples |
| 2 | 0.18 | 123 | 3.59 | 0.26 | 94 | 3.58 | |
| 3 | 0.16 | 142 | 3.59 | 0.21 | 130 | 3.59 | |
| 4 | 0.16 | 135 | 3.56 | 0.20 | 121 | 3.52 | |
| 5 | 0.19 | 120 | 3.61 | 0.27 | 95 | 3.60 | |
| 6 | 0.17 | 138 | 3.60 | 0.22 | 122 | 3.59 | |
| 7 | 0.18 | 137 | 3.54 | 0.21 | 119 | 3.52 | |
| 8 | 0.21 | 113 | 3.75 | 0.32 | 78 | 3.73 | |
| 9 | 0.24 | 117 | 3.81 | 0.30 | 80 | 3.81 | |
| 10 | 0.23 | 105 | 3.80 | 0.82 | 72 | 3.79 | |
| 11 | 0.16 | 154 | 3.74 | 0.23 | 141 | 3.75 | samples of the invention |
| 12 | 0.17 | 157 | 3.82 | 0.21 | 146 | 3.82 | |
| 13 | 0.17 | 146 | 3.81 | 0.20 | 136 | 3.78 | |
| 14 | 0.16 | 150 | 3.73 | 0.22 | 137 | 3.70 | |
| 15 | 0.16 | 152 | 3.83 | 0.21 | 137 | 3.82 | |
| 16 | 0.17 | 143 | 3.79 | 0.21 | 128 | 3.76 | |
| 17 | 0.16 | 155 | 3.82 | 0.22 | 144 | 3.83 | |
| 18 | 0.17 | 154 | 3.83 | 0.22 | 140 | 3.81 | |
| 19 | 0.19 | 91 | 3.61 | 0.22 | 57 | 3.58 | comparative samples |
| 20 | 0.21 | 67 | 3.63 | 0.21 | 32 | 3.43 | |
| 21 | 0.20 | 125 | 3.60 | 0.20 | 89 | 3.58 | |
| 22 | 0.21 | 121 | 3.58 | 0.20 | 91 | 3.57 | |

From the data in Table 2, it is understood that adding a hexacyano-metal complex to silver halide grains in photothermographic materials increases the sensitivity and Dmax of the materials. On the other hand, addition of tetrazaindene compound is effective for reducing the grain size of the silver halide grains, but much desensitizes the grains. In addition, it is further understood that adding a 2-mercaptobenzimidazole compound specifically defined herein to photothermographic materials much improves the materials. As in Table 2, the samples containing the 2-mercaptobenzimidazole compound are fogged little and are desensitized little even after stored in a high-temperature high-humidity atmosphere before processed for image formation.

The invention provides a photothermographic material which contains a 2-mercaptobenzimidazole and in which the silver halide grains have a hexacyano-metal complex on their outermost surfaces, and the photothermographic material is fogged little and has good photographic performances. In addition, before processed for image formation, the material has good storage stability. Further, the 2-mercaptobenzimidazole added to the material is effective for increasing the color sensitivity of the material.

While the invention has been described in detail and with reference to specific embodiments thereof, it will be apparent to one skilled in the art that various changes and modifications can be made therein without departing from the spirit and scope thereof.

What is claimed is:

1. A photothermographic material having, on one surface of its support, at least one type of photosensitive silver halide grains having an outermost surface and an inside part, a non-photosensitive silver salt of an organic acid, a reducing agent for silver ions, and a binder; which contains a compound of the following formula (I) and in which the silver halide grains have a hexacyano-metal complex of the following formula (II) on their outermost surfaces:

(I)

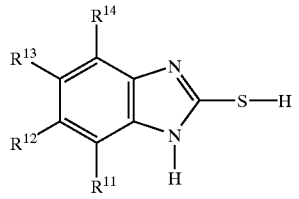

wherein $R^{11}$, $R^{12}$, $R^{13}$ and $R^{14}$ may be the same or different, and each independently represents a hydrogen atom, a halogen atom, a hydroxyl group, an amino group, a nitro group, a cyano group, a carboxyl group or its salt, a sulfo group or its salt, an alkyl group, an alkenyl group, an alkynyl group, an aryl group, a heterocyclic group, or a group of $R^{15}$ —D—; where $R^{15}$ represents a hydrogen atom, a halogen atom, a hydroxyl group, an amino group, a nitro group, a cyano group, a carboxyl group or its salt, a sulfo group or its salt, an alkyl group, an alkenyl group, an alkynyl group, an aryl group, or a heterocyclic group; and D represents —$SO_2$—, —O—, —S—, —CO—, —COO—, —OCO—, —CONH—, —NHCO—, —NHCONH—, —$SO_2$NH—, or —NH$SO_2$—;

$$[M(CN)_6]^{n-} \quad \text{(II)}$$

wherein M represents Fe, Ru, Os, Co, Rh, Ir, Cr or Re; and n indicates 3 or 4; and wherein the hexacyano-metal complex is added to silver halide grains after 96% by weight of the total of silver nitrate has been added to a reaction system.

2. The photothermographic material of claim 1, wherein $R^{11}$, $R^{12}$, $R^{13}$ and $R^{14}$ of formula I may be the same or different, and each independently represents a hydrogen atom, a halogen atom, a hydroxyl group, an amino group, a nitro group, a cyano group, a carboxyl group or its salt, a sulfo group or its salt, an alkyl group optionally having one or more substituents, an alkenyl group optionally having one or more substituents, an alkynyl group optionally having one or more substituents, an aryl group optionally having one or more substituents, a heterocyclic group optionally having one or more substituents, or a group of $R^{15}$—D— where $R^{15}$ represents a hydrogen atom, a halogen atom, a hydroxyl group, an amino group, a nitro group, a cyano group, a carboxyl group or its salt, a sulfo group or its salt, an alkyl group optionally having one or more substituents, an alkenyl group optionally having one or more substituents, an alkynyl group optionally having one or more substituents, an aryl group optionally having one or more substituents, or a heterocyclic group optionally having one or more substituents, and D represents —$SO_2$—, —O—, —S—, —CO—, —COO—, —OCO—, —CONH—, —NHCO——NHCONH—, —$SO_2$NH— or —NH$SO_2$—.

3. The photothermographic material of claim 2, wherein the substituent, which the alkyl group may have is 1 to 20 carbon atoms.

4. The photothermographic material of claim 2, wherein the substituent, which the alkenyl group may have is 2 to 20 carbon atoms.

5. The photothermographic material of claim 2, wherein the substituent, which the alkynyl group may have is 2 to 20 carbon atoms.

6. The photothermographic material of claim 2, wherein the substituent, which the aryl group may have is 6 to 30 carbon atoms.

7. The photothermographic material of claim 2, wherein the heterocyclic is a 5 or 6 membered ring containing a nitrogen or oxygen atom.

8. The photothermographic material of claim 3, wherein the alkyl having one or more substituents is selected from the group consisting of a methyl group, an ethyl group, a propyl group, a hydroxymethyl group, a hydroxyypropyl group, a diethylaminomethyl group, a morpholinomethyl group, a benzyl group, a phenethyl group and a carboxymethyl group.

9. The photothermographic material of claim 4, wherein the alkenyl having one or more substituents is selected from the group consisting of an allyl group, a butenyl group, an octenyl group, a methyl group, an ethyl group, a propyl group, a hydroxymethyl group, a hydroxyypropyl group, a diethylaminomethyl group, a morpholinomethyl group, a benzyl group, a phenethyl group and a carboxymethyl group.

10. The photothermographic material of claim 5, wherein the alkynyl having one or more substituents is selected from the group consisting of a propynyl group, a butynyl group, an octynyl group, a methyl group, an ethyl group, a propyl group, a hydroxymethyl group, a hydroxyypropyl group, a diethylaminomethyl group, a morpholinomethyl group, a benzyl group, a phenethyl group and a carboxymethyl group.

11. The photothermographic material of claim 6, wherein the aryl having one or more substituents is selected from the group consisting of a phenyl group, a tolyl group, a methyl group, an ethyl group, a propyl group, a hydroxymethyl group, a hydroxyypropyl group, a diethylaminomethyl group, a morpholinomethyl group, a benzyl group, a phenethyl group and a carboxymethyl group.

12. The photothermographic material of claim 1, wherein compounds of formula I are selected from the group consisting of

I-1

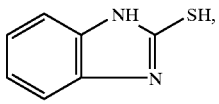

I-2

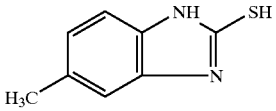

I-3

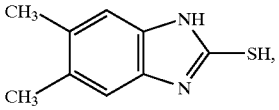

I-4

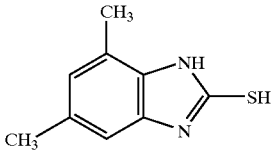

I-5

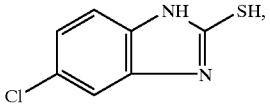

I-6

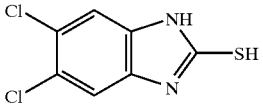

I-7

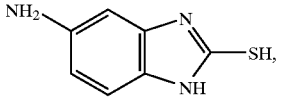

I-8

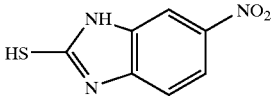

I-9

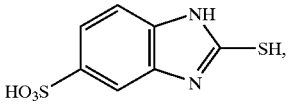

I-10

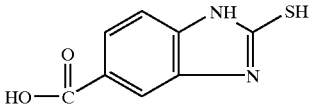

I-11

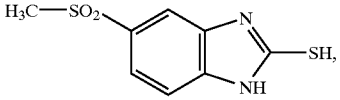

I-12

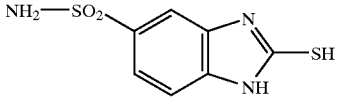

I-13

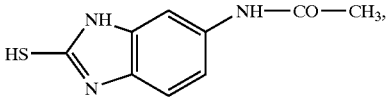

-continued
I-14
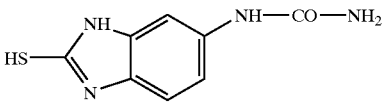
I-15
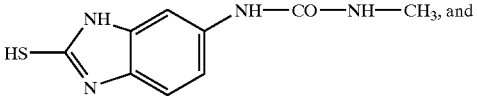
-continued
I-16
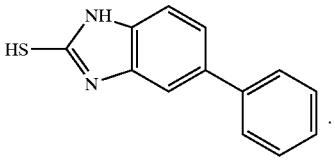
* * * * *